US009033303B2

(12) United States Patent
McDonagh

(10) Patent No.: US 9,033,303 B2
(45) **Date of Patent: *May 19, 2015**

(54) TIE SYSTEM FOR FORMING POURED CONCRETE WALLS OVER CONCRETE FOOTINGS

(71) Applicant: Paladin Industrial, LLC, Providence, UT (US)

(72) Inventor: Gregory M. McDonagh, Millville, UT (US)

(73) Assignee: Paladin Industrial, LLC, Millville, UT (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/866,018

(22) Filed: Apr. 18, 2013

(65) Prior Publication Data

US 2013/0326983 A1 Dec. 12, 2013

Related U.S. Application Data

(63) Continuation of application No. 12/900,373, filed on Oct. 7, 2010, now Pat. No. 8,424,835, which is a continuation-in-part of application No. 12/080,573, filed on Apr. 3, 2008, now Pat. No. 8,348,224.

(51) Int. Cl.

| | |
|---|---|
| ***E04G 17/06*** | (2006.01) |
| ***E04G 11/06*** | (2006.01) |
| ***E04G 11/08*** | (2006.01) |
| ***E04G 17/075*** | (2006.01) |
| ***E04G 17/12*** | (2006.01) |
| ***E04G 17/14*** | (2006.01) |
| *E04G 11/20* | (2006.01) |

(52) U.S. Cl.

CPC ..... *E04G 17/064* (2013.01); *E04G 11/20* (2013.01); *E04G 11/062* (2013.01); *E04G 11/085* (2013.01); *E04G 17/0758* (2013.01); *E04G 17/12* (2013.01); *E04G 17/14* (2013.01)

(58) Field of Classification Search

CPC ..... E04G 11/062; E04G 11/08; E04G 17/064; E04G 17/12

USPC ..... 52/426, 442; 249/13, 18, 34, 213, 216

See application file for complete search history.

(56) References Cited

U.S. PATENT DOCUMENTS

| | | | |
|---|---|---|---|
| 1,224,810 | A | 5/1917 | Tenholder |
| 2,490,228 | A | 12/1949 | Pontiere |
| 3,722,849 | A | 3/1973 | Luyben |
| 3,778,020 | A | 12/1973 | Burrows et al. |
| 4,604,843 | A | 8/1986 | Ott et al. |
| 4,669,234 | A | 6/1987 | Wilnau |
| 4,924,641 | A | 5/1990 | Gibbar et al. |
| 4,949,515 | A | 8/1990 | Krecke |
| 5,038,541 | A | 8/1991 | Gibbar et al. |
| 5,140,794 | A | 8/1992 | Miller |

(Continued)

*Primary Examiner* — Michael Safavi

(74) *Attorney, Agent, or Firm* — David L. Stott

(57) ABSTRACT

A tie system and method for forming a wall from a hardenable building material. In one embodiment, the tie system includes multiple ties configured to be directly interconnected into a vertically extending tie stack such that multiple tie stacks can be positioned over a footing in a spaced apart arrangement. The multiple tie stacks are configured to extend substantially perpendicular between substantially parallel panel structures. Each tie stack includes one or more base members and one or more wall ties, each of which directly attach to each other in a vertically stacked arrangement.

14 Claims, 22 Drawing Sheets

(56) References Cited

U.S. PATENT DOCUMENTS

| | | | |
|---|---|---|---|
| 5,207,931 | A | 5/1993 | Porter |
| 5,452,556 | A | 9/1995 | Taylor |
| 5,459,971 | A | 10/1995 | Sparkman |
| 5,487,241 | A | 1/1996 | Gorrell et al. |
| 5,566,518 | A | 10/1996 | Martin et al. |
| 5,570,552 | A | 11/1996 | Nehring |
| 5,611,182 | A | 3/1997 | Spude |
| 5,713,176 | A | 2/1998 | Hunt |
| 5,799,453 | A | 9/1998 | Westerlund |
| 5,809,726 | A | 9/1998 | Spude |
| 5,922,236 | A | 7/1999 | Zuhl |
| 5,992,114 | A | 11/1999 | Zelinsky et al. |
| 6,041,561 | A | 3/2000 | LeBlang |
| 6,134,861 | A | 10/2000 | Spude |
| 6,230,462 | B1 | 5/2001 | Beliveau |
| 6,250,033 | B1 | 6/2001 | Zelinsky |
| 6,293,067 | B1 | 9/2001 | Meendering |
| 6,401,417 | B1 | 6/2002 | Leblang |
| 6,419,205 | B1 | 7/2002 | Meendering |
| 6,474,033 | B1 | 11/2002 | Luchini et al. |
| 6,622,452 | B2 | 9/2003 | Alvaro |
| 6,739,102 | B2 | 5/2004 | Roy et al. |
| 6,792,729 | B2 | 9/2004 | Beliveau |
| 6,854,230 | B2 | 2/2005 | Starke |
| 6,854,237 | B2 | 2/2005 | Surowiecki |
| 6,880,304 | B1 | 4/2005 | Budge |
| 6,938,387 | B2 | 9/2005 | Belanger |
| 6,993,883 | B2 | 2/2006 | Belanger |
| 7,082,732 | B2 | 8/2006 | Titishov |
| 7,284,351 | B2 | 10/2007 | Cooper et al. |
| 7,426,808 | B2 | 9/2008 | Sanger |
| 7,775,499 | B2 | 8/2010 | Metcalf |
| 7,827,752 | B2 | 11/2010 | Scherrer |
| 2002/0124508 | A1 | 9/2002 | Dunn et al. |
| 2004/0045238 | A1 | 3/2004 | Dunn et al. |
| 2008/0022619 | A1 | 1/2008 | Scherrer |

TIE SYSTEM FOR FORMING POURED CONCRETE WALLS OVER CONCRETE FOOTINGS

CROSS-REFERENCE TO RELATED APPLICATIONS

The present application claims the benefit of and is a continuation of, U.S. patent application Ser. No. 12/900,373, filed on Oct. 7, 2010, issued as U.S. Pat. No. 8,424,835 on Apr. 23, 2013, which is a continuation-in-part of, U.S. patent application Ser. No. 12/080,573, filed on Apr. 3, 2008, now issued as U.S. Pat. No 8,348,224 on Jan. 8, 2013. The disclosures of each application listed above are incorporated by reference in their entireties.

TECHNICAL FIELD

The present invention relates generally to wall forming systems. More specifically, the present invention relates to a tie system for forming walls and the like.

BACKGROUND

Many residential and light commercial structures are built on concrete foundation walls which are formed by pouring concrete into a system of forms that have been erected on a previously poured concrete footing. After the concrete has cured sufficiently, the forms are stripped from the concrete and in most cases soil is back filled on the exterior side of the concrete wall. Typically, the base of each foundation wall is supported on a concrete footing, which is wider than the thickness of the wall itself Ideally, the centerline of the wall is aligned with the centerline of the footing. The footing spreads the load of the structure over a greater area and prevents uneven loading of the foundation wall.

As set forth, one the footing is in place and hardened, a system of forms are constructed over the footing. Such system of forms have typically been constructed using expensive and reusable forms. These forms are typically made of metal and are, thus, very heavy and extremely labor-intensive to assemble and remove after pouring the concrete. Further, due to the significant investment of reusable metal forms, concrete laborers will typically pass the cost on to others for their services. As a result, various other concrete form systems for cement walls have been proposed as alternatives to the heavy metal forms.

One recent development in this field is the use of expanded polystyrene panels, known as insulated concrete forms. These newer form systems utilize pairs of horizontally extending foam panels which are connected in parallel with a series of rigid plastic ties. Complete wall form systems are typically created by vertically stacking these horizontally extending paired foam panels into larger arrays. Concrete is then poured between the panels of the completed foam wall form system. The thickness of the poured concrete walls can be adjusted by the selection and utilization of form ties of appropriate size. Subsequent to concrete hardening these foam panels are left in place to serve as insulation.

Although such insulated concrete forms are lighter than the conventional metal form systems, the forms are bulky and, therefore, the cost for shipping such forms can be expensive. Further, due to the bulky and cumbersome nature of these forms, they are highly susceptible to the inherent risk of damage during transportation and even during installation. Another problem with the insulated concrete forms is the requirement for numerous different types of parts to fit the variations of the footprint of both residential and commercial construction. Due to these numerous different parts and sizes, the insulated concrete forms are high in cost to manufacture and therefore, such high cost is past on to the consumers and builders. Furthermore, the numerous different types of parts in the insulated concrete forms are complicated to construct and require skilled laborers who understand the complexities for such construction. In addition, another inherent problem with the insulated concrete forms is the difficulty to match such forms to the predetermined required lengths along the footing usually evident at corners and ends, in which shortening the forms by cutting and then adhesively repairing the forms is required, often leaving the forms in a damaged state with reduced structural integrity. Such problem further increases the complexity and time required to build the forms in preparation to pour the concrete.

Another problem with prior art systems, particularly conventional metal forms, involves the installation of rebar, wire mesh, or other reinforcing members between the parallel panels that are to be embedded within the finished foundation wall. The techniques employed typically involve various means and methods for suspending rebar haphazardly between the panels with wire ties. Although such wire ties have been used for years, inaccurate placement of the rebar is common, often resulting in unsatisfactory reinforcement of the foundation walls. Further, such wire tying techniques are labor intensive, time consuming and a tedious process.

Further, often it is desired to have walls with a radius; however, conventional metal or steel forms are not made to provide a wall with a constant radius. Rather, the best the conventional metal or steel forms can implement is segmenting a wall with multiple flat faced portions at different orientations at the dimension of the form itself. There are specialized aluminum forms that are specifically made to form curved walls, but such specialized aluminum forms are extremely expensive and arc limited by the fixed radial dimensions of the form itself.

Based on the foregoing, it would be advantageous to provide a concrete form system that is low in cost for builders and, thus, the home owner, minimizes the waste of form materials, provides a non-complicated system with less part types and that inherently can be adjusted to any required lengths for ends and corners or overall footprints required for the foundation walls. Further, it would be advantageous to provide a concrete form system that is less labor intensive, light weight and compact and, further, provides for ready and precise assembly of reinforcing rebar materials to be placed in concrete forms. Even further, it would be advantageous to provide a concrete form system that readily facilitates forming walls with a radius that is low in cost and is not limited by the dimension of the forms.

BRIEF SUMMARY OF THE INVENTION

Embodiments of the present invention are directed to a tie system and method for supporting panel structures spaced over a footing to receive a hardenable building material. In accordance with one embodiment of the present invention, the tie system includes a first base portion, a second base portion and a wall tie. The first and second base portions each having a base extension and an upstanding portion, the base extension configured to extend horizontally over the footing and configured to be securable to the footing, and the upstanding portion of the first base portion and the second base portion each configured to extend vertically from the base extension. The wall tie includes a first elongated wall portion and a second elongated wall portion with a cross-member portion extending therebetween. The first elongated wall portion configured to vertically extend from and be connected to the upstanding portion of the first base portion and the second elongated wall portion configured to vertically extend front and he connected to the upstanding portion of the second base portion.

In one embodiment, the tie system includes one or more other wall ties each including the first and second elongated wall portions with the cross-member portion extending therebetween. The one or more other wall ties are configured to vertically stack and mate to each other to form a vertically extending tie stack such that the first and second elongated wall portions vertically extend from and attach to each other. In another embodiment, the tie system includes an intermediate adapter configured to be coupled between the wall tic and the one or more other wall ties.

In still another embodiment, the first elongated wall portion includes a first flat surface and the second elongated wall portion includes a second flat surface. The first flat surface faces directly opposite the second flat surface. With this arrangement, the first flat surface of each of the wall ties is configured to he secured to one or more first panel structures and the second flat surface of each of the wall ties is configured to be secured to one or more second panel structures.

In another embodiment, the cross-member portion of each wall tie within the tie stack is configured to be positioned generally in a common plane. The common plane is configured to be perpendicular to the footing and is configured to he perpendicular to the first flat surface and the second flat surface of each of the wall ties.

Further, in another embodiment, the tie system includes a finish tie having an elongated portion extending between a first end portion and a second end portion. Each of the first end portion and the second end portion defines a channel therein. Each channel of the finish tie is configured to be positioned over and maintained on the respective one or more first and second panel structures.

In another embodiment, the first base portion is separate and discrete from the second base portion and is configured to be interconnected by the wall tie. Further, in another embodiment, the first base portion and the second base portion are unitary and seamless relative to the wall tie. In still another embodiment, the base extension of at least one of the first base portion and the second base portion includes a bendable portion for securing a portion of the base extension over a side surface of the footing.

In accordance with another embodiment of the present invention, the tie system includes multiple base members and multiple wall ties. The multiple base members are configured to he positioned over and securable to a footing in a spaced apart arrangement. The multiple wall ties are configured to be coupled together to form multiple vertically extending wall tie stacks, wherein each wall tie stack is configured to be coupled to one or more of the multiple base members to form a tie stack. Each all tie includes a first elongated wall portion and a second elongated wall portion with a cross-member portion extending therebetween. The first elongated wall portion includes a first flat surface and the second elongated wall portion including a second flat surface. The first flat surface faces directly opposite the second flat surface. With this arrangement, the first flat surface of each of the wall ties is configured to be secured to one or more first and structures and the second flat surface of each of the wall ties is configured to be secured to one or more second panel structures.

In one embodiment, the cross-member portion of each wall tie within the tie stack is configured to extend generally in a common plane. The common plane is configured to be substantially perpendicular to the footing and configured to be substantially perpendicular to the first flat surface and the second flat surface of the wall ties.

In another embodiment, the tie system includes multiple finish ties. Each finish tie having an elongated portion extending between a first end portion and a second end portion, wherein each of the first end portion and the second end portion defines a channel therein. Each channel of the finish tie being configured to be positioned over and secured to the respective one or more first and second panel structures.

In still another embodiment, the multiple base members include a first base portion and a second base portion configured to be coupled to the wall of stack. The first base portion and the second base portion each including a base extension and an upward extending portion. The upward extending portion is configured to be connected to a bottom one of the wall ties of the wall tie stack.

In one embodiment, the base members are configured to be alignable along a curved footing portion with a radius so that the vertically extending tie stacks correspond with the base members to facilitate the one or more first and second panel structures being secured to the tie stacks with a panel structure radius that corresponds with the radius of the curved footing portion of the footing.

In accordance with another embodiment of the present invention, a method of supporting panel structures spaced over a footing to receive a hardenable building material is provided. The method includes providing multiple base members and wall ties, each base member including an upstanding portion extending vertically from a horizontally extending base extension, each wall tie including a first elongated wall portion and a second elongated wall portion with a cross-member portion extending therebetween, the first and second elongated wall portions configured to extend vertically relative to the footing and the first and second elongated wall portions including a respective first flat surface and a second flat surface, the first flat surface and the second flat surface facing in directly opposite directions; securing the multiple base members to the footing in a spaced apart arrangement along the footing; attaching a first level of the wall ties to each of the base members by mating end portions of the first and second elongated wall portions of the wall tie to the upstanding portions of the base members; attaching one or more additional levels of wall ties to each of the previously attached wall ties by mating the end portions of the first and second elongated wall ties of other wall ties together to vertically build separate and discrete tie stacks; securing one or more first panel structures to the first flat surface of the first elongated wall ties of each of the tie stacks; and securing one or more second panel structures to the second flat surface of the second elongated wall ties of each of the tie stacks.

In one embodiment, the method also includes the step of securing multiple finish ties to an upper end of the one or more first and second panel structures such that each finish tie includes an elongated structure having a first end portion and a second end portion with a channel defined therein, the channel sized to receive the upper end of the panel structures.

In another embodiment, the step of securing the one or more first and second panel structures includes bowing the one or more first and second panel structures against the respective first and second elongated wall ties in a curved orientation to follow a radius of the footing.

In another embodiment, the step of securing the base members includes orienting at least some of the base members along a curved footing portion with a radius so that the vertically extending tie stacks correspond with the base members to facilitate the one or mote first and second panel structures being secured to the tie stacks with a panel structure radius that corresponds with the radius of the curved footing portion of the footing.

In still another embodiment, the method includes the step of laying rebar over the cross-member portion of wall ties of any one of the first level or the additional levels of the wall ties. Further, in another embodiment, the method includes the step of inserting a water stop into the footing and attaching the first level of wall ties over the water stop.

BRIEF DESCRIPTION OF THE SEVERAL VIEWS OF THE DRAWINGS

To further clarify the above and other advantages and features of the present invention, a more particular description of the invention will be rendered by reference to specific embodiments thereof which are illustrated in the appended drawings. It is appreciated that theses drawings depict only typical embodiments of the invention and are therefore not to be considered limiting of its scope. The invention will be described and explained with additional specificity and detail through the use of the accompanying drawings in which.

DETAILED DESCRIPTION OF THE INVENTION

Figure 1:
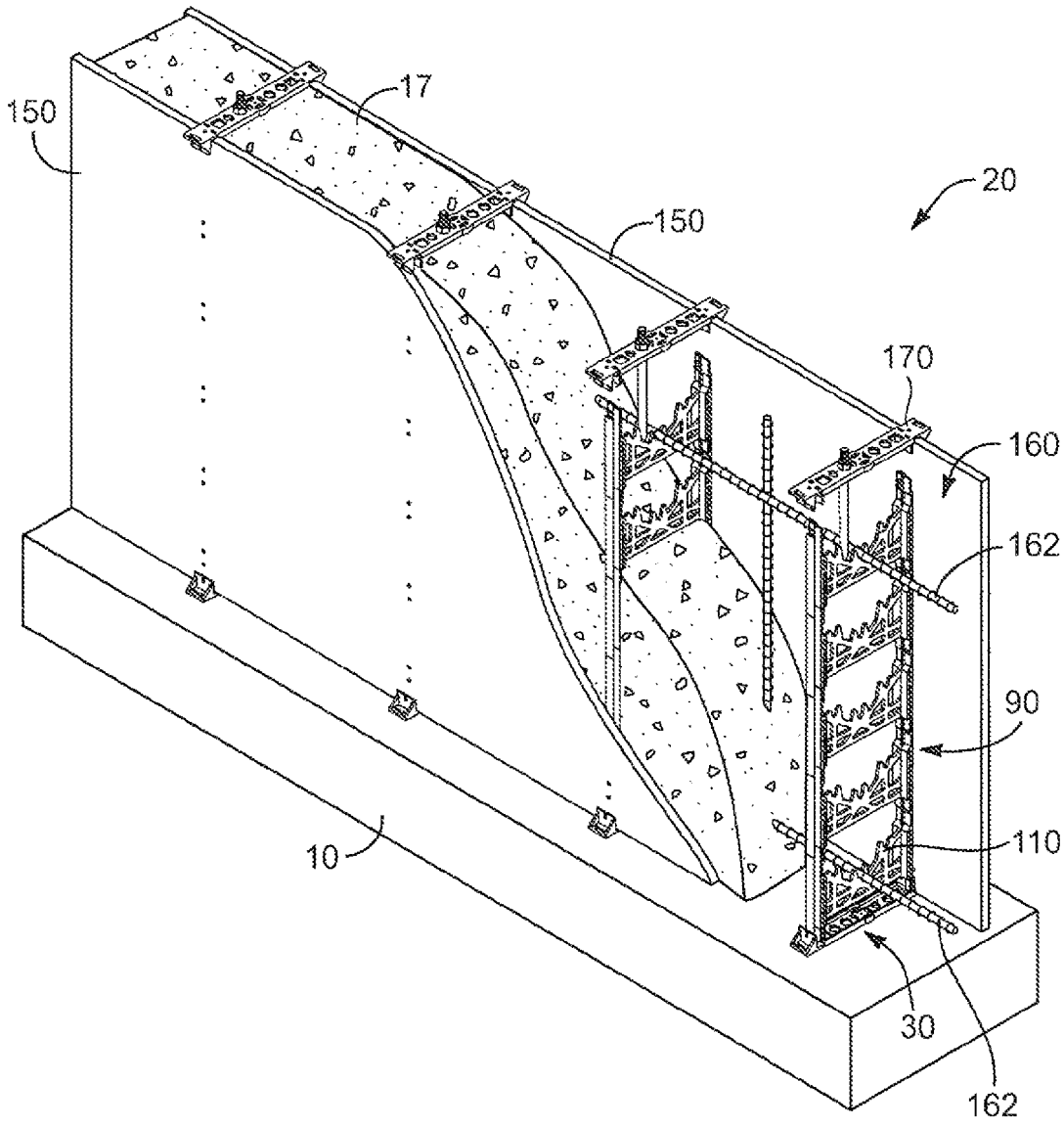
FIG. 1 is a perspective view of an assembled tie system and concrete wall with portions removed, according to one embodiment of the present invention.

Referring first to FIG. 1, there is disclosed a partial view of a tie system 20, according to the present invention. The primary components of the tie system 20 comprise abase tie 30 and a wall tie 90. As will be set forth herein, the base tie 30 and wall tie 90 are utilized as support structure in conjunction with panel structures 150, such as typical plywood or Form ply, to build concrete forms for forming concrete walls for various residential and commercial buildings.

Such a tie system 20 includes multiple base ties 30 and multiple wall ties 90. The base ties 30 are placed and secured, in a spaced apart arrangement, to a concrete footing 10. Each base tie 30 receives a stack of wall ties 90 configured to extend in a vertical arrangement to form a tie stack 160. Each of the wall ties 90, within a stack, are configured to be directly interconnected together and configured to extend vertically, one above another. After running a first course of wall ties 90, horizontal rebar 162 can be run along a cross-member 110 of the wall ties 90, after which, additional courses of wall ties 90 can be built upon each other, running horizontal rebar 162 as needed, until the tie stacks 160 are built to the desired height. Once the tie stacks 160 are complete, panel structures 150 can be placed along each side of the tie stacks 160 in a parallel fashion and secured thereto. In addition, a finish tie 170 is provided to be positioned over the panel structures 150. Concrete can then be poured between the parallel panel structures 150 and into the tie system 20. Once the concrete wall 17 has set, the panel structures 150 can then be removed and utilized for another tie system or for other purposes for the structure being built upon the concrete foundation. As readily understood by one of ordinary skill in the art, the tie system 20 of the present invention provides advantages of being low in material cost and is time efficient for forming concrete walls for both residential and commercial dwellings.

It should be noted that the tie system is described herein as a concrete wall forming system due to concrete typically being used in the art for foundation walls. However, the tie system of the present invention is not limited to concrete, but rather, the tie system can be employed with any hardenable liquid building material, including, but not limited to, typical concrete, various cement and/or concrete composites, (i.e., fiber reinforced cements, polymer composite cements), lightweight type cements or concrete, or any other suitable pourable and curable building material known in the art that will meet the structural integrity requirements for a given structure. Furthermore, as can be appreciated by one of ordinary skill in the art, the tie system of the present invention can be employed to form above ground level walls as well as foundation walls. In addition, it is intended that the trim footing can mean any stable structure the base tie of the present invention can be mounted or secured to, such as, a concrete footing or even traditional concrete forms.

Figure 2:
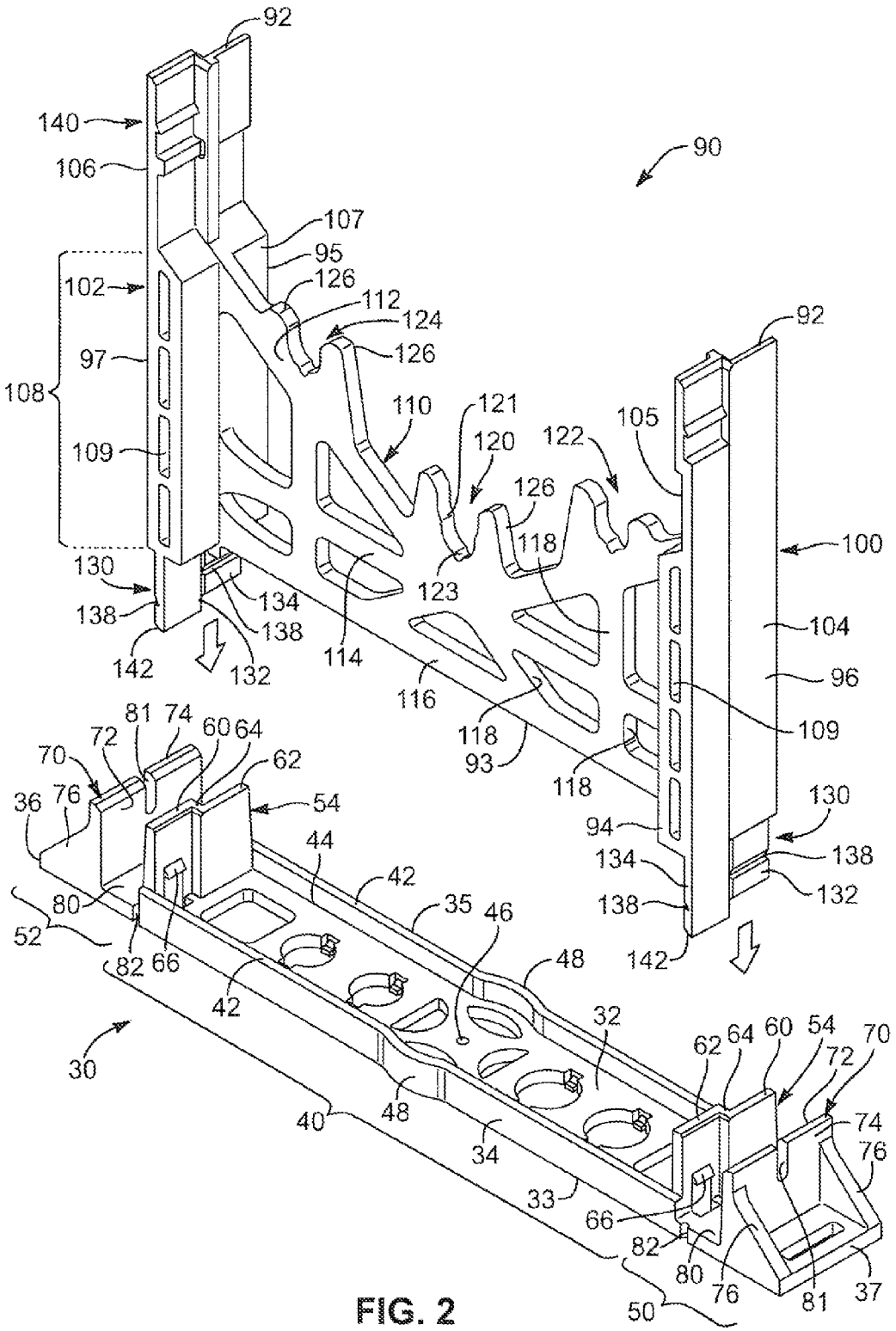
FIG. 2 is a perspective view of an unassembled base tie and wall tie, according to an embodiment of the present invention.

Now referring to FIG. 2, there is disclosed an enlarged unassembled view of the base tie 30 and the wall tie 90, according to an embodiment of the present invention. Such a base tie 30 and wall tie 90 include structural features that allow the tie system to be placed under maximum loads while pouring the concrete while still maintaining the structural integrity within the tie system. The base tie 30 and wall tie 90 are ideally made from a semi-rigid or substantially rigid polymeric material, such as high density polyethylene. Other polymeric materials can also be used, such as, polypropylene, polycarbonate, acrylonitrile butadiene styrene or polyamide or any other suitable polymeric material known to one of ordinary skill in the art. Further, such base tie 30 and wall tie 90 can be manufactured using molds with an injection molding process, or any other suitable manufacturing method, such as mold casting or machining, as known in the art.

First referring to the base tie 30, such a base tie can include an upper side 32, a bottom side 33, a front side 34, a back side 35, a left side 36 and a right side 37, the upper side 32 configured to face upward and the bottom side 33 configured to be positioned, face down, against a top surface of a concrete footing 10 (FIG. 1), The base tie 30 can include a first end portion 50 and a second end portion 52 with an intermediate portion 40 extending therebetween. In one embodiment, the first end portion 50 and the second end portion 52 can each be an extension of the intermediate portion 40, on opposite sides thereof, along a longitudinal length of the base tie 30. Furthermore, the intermediate portion 40 can be a generally elongated portion in comparison to the first end portion 50 and the second end portion 52. The intermediate portion 40 can also include rails 42 extending upward at the upper side 32 of the intermediate portion 40 to, thereby, define a recess 44 in the upper side 32 of the intermediate portion 40. The rails 42 can extend longitudinally along the length of the upper side 32 of the intermediate portion 40, of which the rails can define the front side 34 and back side 35 of the intermediate portion 40. The bottom side 33 of the base tie 30 is preferably substantially planar or flat since, as previously set forth, the bottom side 33 is sized and configured to be secured to the top surface of the concrete footing.

The recess 44 defined in the upper side 32 of the intermediate portion 40 can include various openings, including a center hole 46, extending through the upper side 32 to the bottom side 33 of the intermediate portion 40. The center hole 46 can be sized and configured to secure the base tie 30 to the concrete footing 10 (FIG. 1). The other openings can be utilized for minimizing the material required while maintaining structural integrity in the base tie as well as for other purposes set forth more fully herein. In one embodiment, the intermediate portion 40 also can include a bulge 48, defined in part by the rails 42, at a central portion thereof sized and configured to maintain the structural integrity of the base tie 40 as well as allow for a hammer head to nail a concrete nail through center hole 46 to minimize potentially hitting the rails while hamming such concrete nail. As such the bulge 48 is sized and configured larger than the typical hitting surface of a hammer head.

Figure 2A:
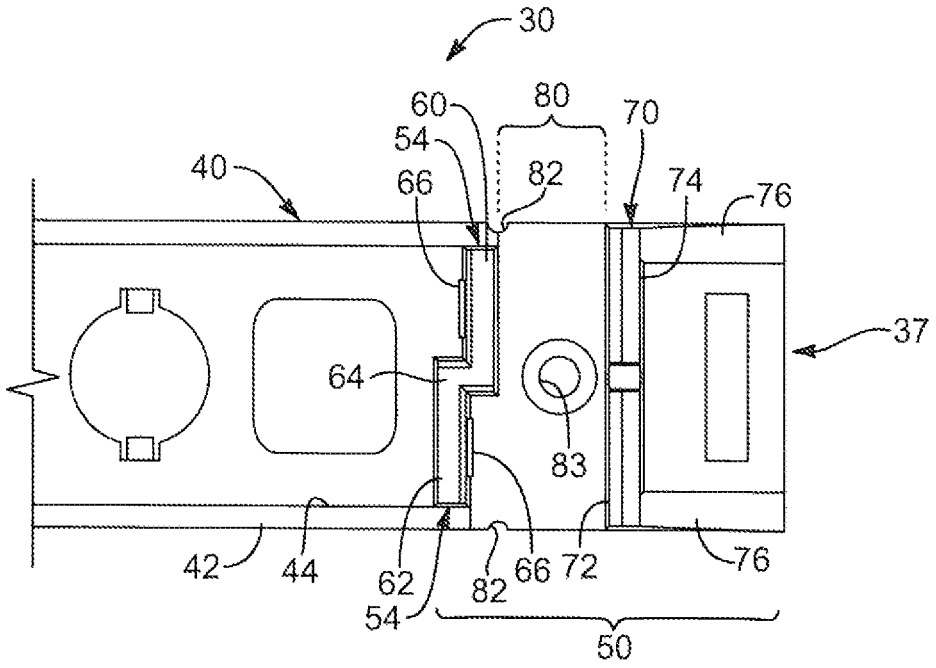
FIG. 2A is a top view of a first end portion of the base tie, according to the present invention.

Referring now to FIGS. 2 and 2A, as previously set forth, the first end portion 50 and the second end portion 52 can extend from the intermediate portion 40 of the base tie 30. The first end portion 50 can be substantially identical or similar to the second end portion 52. In particular, such end portions can each include an attachment portion 54 and a support wall 70. The attachment portion 54 and support wall 70 both extend upward at the upper side 32 of the base tie 30 and define a channel 80 therebetween. Each attachment portion 54 can include a first attachment portion 60 and a second attachment portion 62 that extend upward and laterally between the front side 34 and back side 35 of the base tie 30. The first attachment portion 60 can be closer to the end or right side 37 of the base tie 30 than the second attachment portion 62. Likewise, the first attachment portion 60 on the left side 36 of the base tie 30 can be closer to the left side 36 than the second attachment portion 62. Further, the attachment portion 54 can be unitary in structure with a mid portion 64 interconnecting the first attachment portion 60 and the second attachment portion 62, of which the mid portion 64 extends longitudinally with the base tie 30. As such, the first attachment portion 60 and the second attachment portion 62 extend laterally across each of the first and second end portions 50 and 52 in an offset manner with the mid portion 64 extending longitudinally therebetween.

In addition, each attachment portion 54 can include one or more protrusions 66 sized and configured to lock or attach to the wall tie 90. In one embodiment, the attachment portion 54 on the right side 37 can include a protrusion 66 on the inner surface of the first attachment portion 60 and a protrusion 66 on the outer surface of the second attachment portion 62. Likewise, on the left side 36 of the base tie 30, the first attachment portion 54 can include a protrusion 66 on the inner surface and a protrusion 66 on the second attachment portion 62 on the outer surface of the attachment portion 54. Such protrusions 66 on the attachment portion 54 are sized and configured to interconnect and removably lock with the wall tie 90, of which further explanation will be provided for the interconnection hereafter.

Each of the first end portion 50 and the second end portion 52 can also include a support wall 70. The support wall 70 can include an inner surface 72 and an outer surface 74, extending upward and between the front side 34 and back side 35 of the base tie 30. The support wall 70 can include additional supports 76 extending from the outer surface 74 of the support wall to provide additional structural integrity to the support wall. Such additional supports can extend, for example, from an intermediate height of the outer surface 74 of the support wall 70, angling downward toward a corresponding end of the first end portion 50 and the second end portion 52. Further, the additional supports 76 can define a portion of the front side 34 and back side 35 of each of the respective first and second end portions 50 and 52 of the base tie 30. As previously set forth, the upward extension of the both the support wall 70 and the attachment portion 54 define a channel 80 in each of the first end portion 50 and the second end portion 52. Such a channel 80 extends (laterally to the longitudinal length of the base tie 30) between the front side 34 and back side 35 of the base tie 30 at each of the first end portion 50 and the second end portion 52. Further, the channel 80 is sized and configured to receive and support a panel structure 150 (FIG. 1), such as plywood or Form ply, as previously set forth. Furthermore, the support wall 70 can define a channel slot 81, extending through the support wall 70, sized and configured to receive a fastener therethrough. In other words, such channel slot 81 can be configured to facilitate fastening the panel structure within the channel 80 and, thus, to the base tie 30.

Now with reference to the wall tie 90 of the tie system 20, the wall tie 90 includes an upper side 92, bottom side 93, a front side 94, a back side 95, a right side 96 and a left side 97. Further, such a wall tie 90 can include a first elongated wall portion 100 and a second elongated wall portion 102 with a cross-member 110 extending therebetween. The first elongated wall portion 100 includes an outer surface 104 and an inner surface 105, the outer surface 104 defining, at least in part, the right side 96 of the wall tie 90. Likewise, the second elongated wall portion 102 includes an outer surface 106 and an inner surface 107 with the outer surface 106 defining, at least in part, the left side 97 of the wall tie 90. The outer surfaces of the first and second elongated wall portions 100 and 102 can be substantially flat and sized and configured to be positioned against and secured to the panel structure 150, the panel structure also being positioned in the channel 80 of the base tie 30, as previously set forth.

Furthermore, the first and second elongated wall portions 100 and 102 include an intermediate wall portion 108 with an inner surface that can be raised. Such raised surface can be thicker than the remaining portions of both the first and second elongated wall portions 100 and 102. Further, such intermediate wall portion 108 is sized and configured to be secured to the panel structures with fasteners and is, therefore, configured to be thicker to increase the structural integrity for such attachment. In addition, the intermediate wall portion 108 for each of the first and second elongated wall portions 100 and 102 can include and define holes 109 extending between the front side 94 and hack side 95 of the wall tie 90. Such holes 109 defined in each intermediate all portion 108 of the wall tie 90 limits the amount of material necessary for the structural integrity of the wall tie while also adding structural thickness for being secured to the panel structures.

As previously set forth, the first and second elongated wall portions 100 and 102 are interconnected by a cross-member 110. The cross-member 110 can extend from respective inner surfaces of the first and second elongated wall portions 100 and 102 at one or more locations. In particular, the cross-member 110 can include upper beams 112, a mid beam 114 and a lower beam 116 with multiple struts 118 interconnecting such upper, mid and lower beams. The upper beams, mid beam and lower beam can extend from respective upper, mid and lower portions of the inner surface of the intermediate wall portion 108 of both the first and second elongated wall portions 100 and 102. According to this arrangement, the cross-member 110, including the multiple beams and struts, are sized and configured to provide the structural integrity necessary to withstand the concrete loads placed thereon.

Furthermore, the cross-member 110 can include multiple rebar holders. In particular, the cross-member 110 can include a center rebar holder 120 with a right mbar holder 122 and a left rebar holder 124 positioned above the center rebar holder 120. The center mbar holder 120 is defined at a juncture between the upper beams 112 of the cross-member 110 with a u-shaped configuration. The upper beams can include cross-member extensions 126, extending upward, to define each of the center, right and left rebar holders 120, 122 and 124 each having a u-shaped configuration. Of course, such rebar holders can include other configurations with means for maintaining rebar. With such an arrangement, rebar can be readily placed within one or more of the u-shaped configurations for substantially exact rebar placement and positioned in a time efficient manner. Each of the center rebar holder 120 and right and left rebar holders 122 and 124 can be configured with structure to attach and hold the rebar, with an interference type fit, in position or can be configured to allow the rebar to rest within the various u-shaped configurations.

In addition, the center rebar holder 120 can be sized and configured to receive both ½" diameter and ⅝" diameter rebar, the ½" diameter rebar held in a lower portion of the center rebar holder and the ⅝" diameter rebar held in an upper portion with a ridge 121 defined therebetween. That is, the ridge 121 defines an upper edge of the lower portion sized for the ½" diameter rebar and the ridge 121 defines a lower edge of the upper portion sized for the ⅝" diameter rebar. Further, the center rebar holder 122 can include a rebar groove 123 defined at a bottom of the center rebar holder 122. Such rebar groove 123 is sized and configured to receive a raised seam on the periphery of rebar and, in this case, the ½" diameter rebar. The right and left rebar holders 122 and 124 are sized and configured to receive ½" diameter rebar therein each including a rebar groove defined therein.

According to an important aspect of the present invention, each of the first and second elongated wall portions 100 and 102 can include a lower attachment portion 130 and an upper attachment portion 140. The lower attachment portion 130 of the wall tie 90, located at a lower portion of each of the first and second elongated wall portions 100 and 102, can be sized and configured to attach and interconnect or interlock (in a removable manner) to the attachment portion 54 of a respective and corresponding first and second end portion 50 and 52 of the base tie 30. The upper attachment portion 140 of each of the first and second elongated wall portions 100 and 102 can be sized and configured to substantially mimic the attachment portion 54 of the base tie 30 so that additional wall ties 30 can be stacked vertically upon each other to, thereby, build the wall ties 30 to the approximate desired height for the concrete wall form.

Figure 2B:
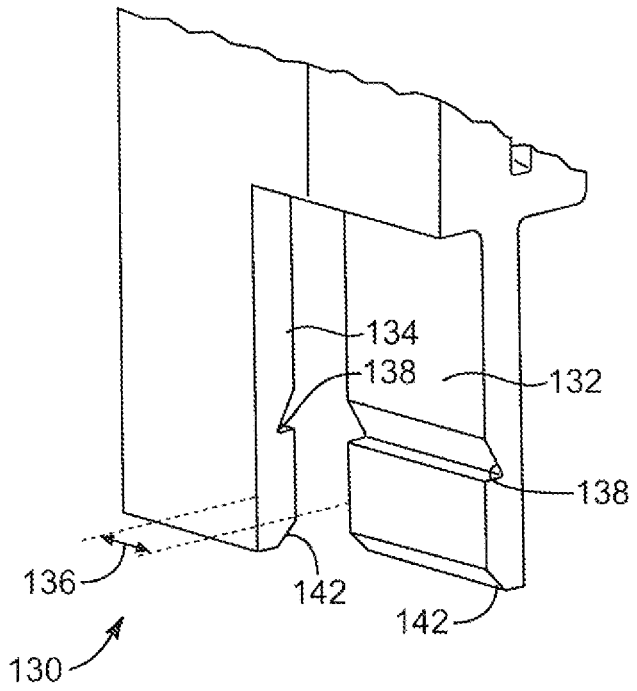
FIG. 2B is a perspective view, from a right rearward side of a lower attachment portion of the wall tie depicted in FIG. 2, according to the present invention.

With respect to FIGS. 2 and 2B, there is disclosed the lower attachment portion 130 of the wall tie 90. Each lower attachment portion 130, extending from the first and second elongated wall portions 100 and 102, can include a first lower attachment portion 132 and a second lower attachment portion 134. The first and second lower attachment portions 132 and 134 can be configured to extend downward from the respective elongated wall portion and define a gap 136 therebetween. Further, the first lower attachment portion 132 can be laterally offset with respect to the second lower attachment portion 134 sized and configured to correspond with the offset arrangement of the attachment portion 54 of the base tie 30 (See also FIG. 2A). Further, the first lower attachment portion 132 for both the first and second elongated wall portions 100 and 102 can include a groove 138 that extends laterally within the outer surface of the first lower attachment portion 132. Similarly, the second lower attachment portion 134 for both the first and second elongated wall portions 100 and 102 also can include a groove 138 that extends laterally within the inner surface of the second lower attachment portion 134. In addition, each of the first and second lower attachment portions 132 and 134 can include a tapered free end 142 so as to allow ready insertion and attachment of the wall tie 90 to the base tie 30.

Figure 3:
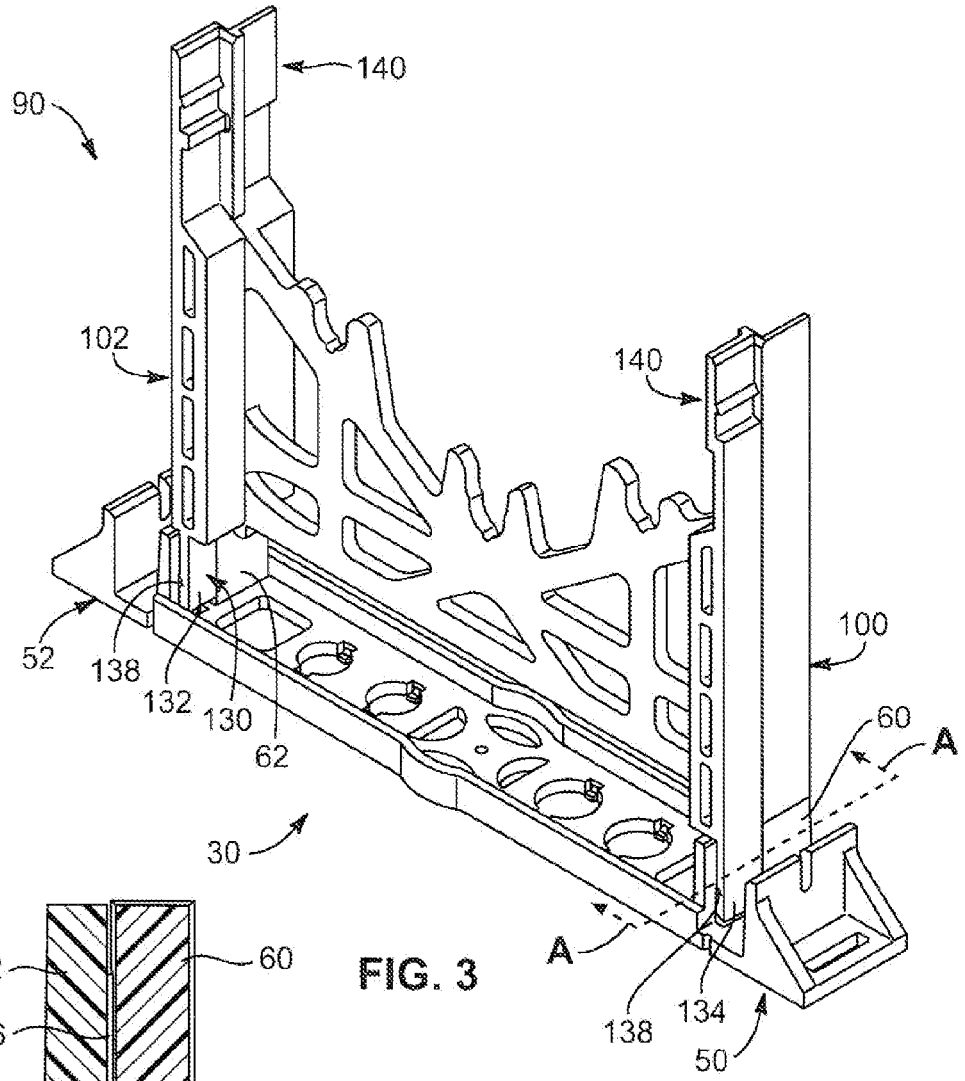
FIG. 3 is a perspective view of an assembled base tie and wall tie, according to the present invention.
Figure 3A:
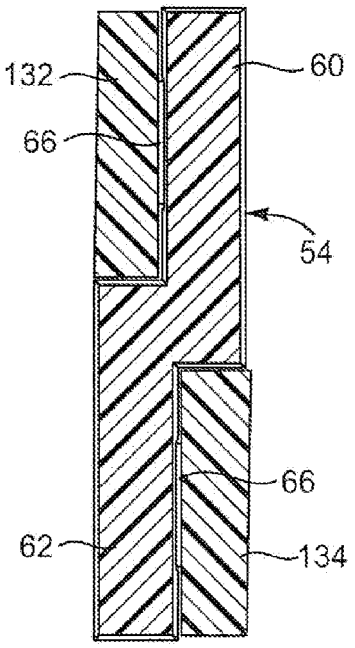
FIG. 3A is a cross-sectional view, taken along line A, of an interconnection between the base tie and the wall tie, according to the present invention.

With reference now to FIGS. 3 and 3A, there is illustrated the wall tie 90 assembled with the base tie 30. More particularly, the first and second lower attachment portion 132 and 134 of each first and second elongated wall portions 100 and 102 are sized and configured to mate and interconnect with a respective one of each of the first and second attachment portions 60 and 62 of each first and second end portion 50 and 52 of the base tie 30. Further, the groove 138 within the first and second lower attachment portion 132 and 134 is sized and configured to mate and interconnect with the protrusion 66 of the first and second attachment portion 60 and 62 of the base tic 30 to thereby, provide a locking arrangement. In this manner, the offset and gaped arrangement between the first and second lower attachment portions 132 and 134 of the wall tie 90 readily interconnects and attaches to the offset and unitary arrangement of the attachment portion 54 (having a respective first and second attachment portion 60 and 62) of the base tie 30. As such, the wall tie 90 is configured to attach and interconnect with the base tie 30. Further, as previously set forth, the wall tie 90 includes an upper attachment portion 140 that mimics the structure of the attachment portions 54 of the base tie 30. As such, the lower attachment portions 130 of a second wall tie 90 can attach and interconnect with the upper attachment portion 140 of a lower wall tie 90 therebelow to, thereby, facilitate vertically building a stack of wall ties 90 upon a single base tie 30 to the desired height of the concrete wall form (See FIG. 1).

Based on the foregoing, the tie system of the present mention is advantageous in comparison to the prior art concrete form systems due to the tie system comprising primarily two components, the base tie and the wall tie. Such two components in the tie system inherently provides advantages of being compact for shipping purposes, minimizing the risk of damaging the components during shipping and even while building the concrete forms. Further, due to the compact and light nature of the tie system with primarily two different components, installing the tie system to build the concrete forms is less laborious than prior art concrete form systems with minimized complexity. Moreover, the tie system of the present invention includes greater cost and time efficiency in regard to manufacturing, shipping and assembling such tie system.

Figure 4:
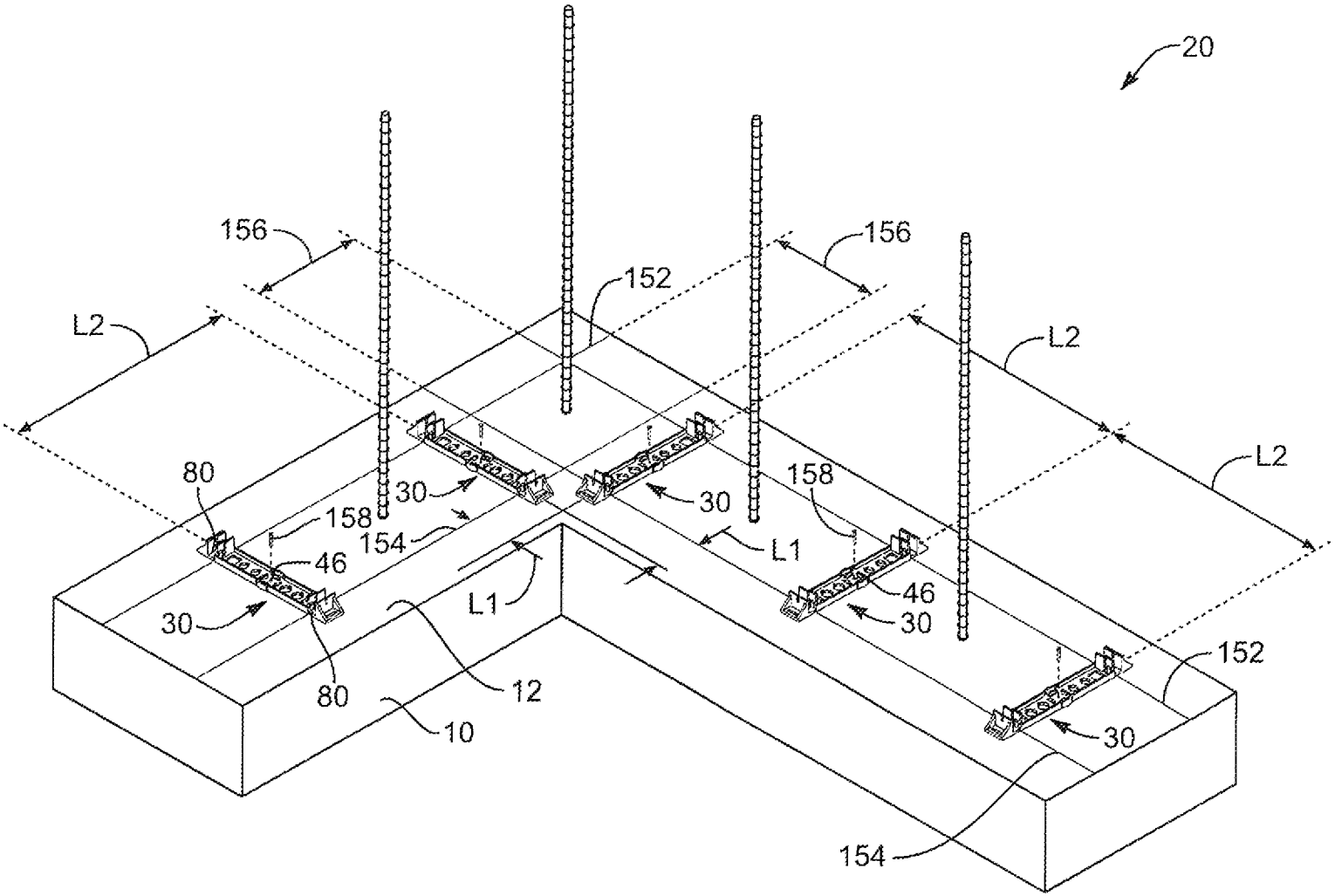
FIG. 4 is a perspective view of a typical concrete footing with base ties positioned thereon, according to one embodiment of the present invention.

With respect to FIGS. 4 through 14, the process and method for assembling the tie system to build concrete forms, according to an embodiment of the present invention, will now be described. Referring first to FIG. 4, there is disclosed a step for securing the base tie to a concrete footing 10 with a corner. The footing 10 can first be marked with a chalk line on a top surface 12 thereof, marking the position for an outside perimeter 152 and inside perimeter 154 of the concrete wall. Such marked chalk line should correspond with the desired concrete wall thickness 156. Likewise, the base ties and wall ties employed should correspond with the desired concrete wall thickness, sized, but not limited to, according to the most typical concrete wall thicknesses of about 8", 6" or 4" thick concrete walls. Once the chalk lines are marked, placement of the first base tie 30 can be measured a first length L1 from the inside corner chalk line for the concrete wall. Such first length L1 can be preferably about 3" from the inside corner chalk line. Placement of the other base ties 30 along the length of the footing 10, can be spaced a second length L2, separate and distinct from each other. The last base tie 30 along the length of the footing 10, whether at an end or a corner, can be measured the first length L1 (approximately 3") from such end or corner. The same procedure can be followed along the other length of footing 10 from the inside corner chalk line, as depicted.

The second length L2 in which the base ties 30 are spaced can vary upon parameters, namely (but not limited to), the thickness of the panel structure and the height of the concrete wall. The thickness of a panel structure that can be employed with the present invention can include, but is not limited to, 7/16", ½", 9/16", ⅝", 11/16", ¾', 1", or 1⅛" thickness. When using typical plywood, the preferred parameters are as follows: For a one to two foot concrete wall height utilizing a plywood thickness between 7/16" to 1⅛" thick, the spacing for the second length L2 is preferably a maximum of about twenty-four inches. If the wall height is 2½ feet, the spacing for the second length L2 is a maximum of about nineteen inches utilizing plywood at 7/16" or ½" thick and a maximum of about twenty-four inch spacing for plywood 9/16" through 1⅛" thick. Further, if the wall height is three feet, the spacing for the second length L2 is a maximum of about sixteen inches with a 7/16" or ½" thick plywood and a maximum of about twenty-four inch spacing for 9/16" through 1⅛" thick plywood. If the wall height is 3½ feet, the spacing for the second length L2 is a maximum of about twelve inches utilizing plywood at 7/16" or 1/2" thick, and a maximum of about a 19 inch spacing for plywood at 9/16" or ⅝" thick, and about a maximum of about twenty-four inch spacing using plywood at 11/16" through 1⅛" thick. For a wall height of four feet, the spacing for the second length L2 can be a maximum of about sixteen inches with 9/16" or ⅝" thick plywood and a maximum of about twenty-four inch spacing using 11/16" through 1⅛" thick plywood. Further, it should be noted that it is preferred to utilize typical plywood having a thickness greater than ½" for a wall height of four feet. Again, as set forth, the above-indicated parameters relate to the panel structure being typical plywood. When using Form ply, it is preferred to utilize ½" thick panels for any wall height up to ten feet. The preferred panel structures employed that are rated as Form ply are typically high density overlay ("HDO") plywood or medium density overlay ("HDO") plywood. Other suitable panel structures, as known to one of ordinary skill in the art, can also be employed with the tie system of the present invention.

For accurate placement and alignment, the base tie 30 can include a notch 82 at the inside edge of each channel (See FIG. 2A). Such notch 82 is configured to be aligned and correspond with the inside perimeter 152 and outside perimeter 154 chalk lines marked on the footing 10. Once the base ties 30 are placed with their respective notches 82 aligned with the chalk lines and at the correct spacing as set forth above, such base ties 30 should be secured to the footing preferably with a 1½" concrete nail 158. Such nail 158 can be nailed through the center hole 46 in the base ties 30. If desired, additional concrete nails can be run through other portions, preferably within an interior portion, of the base tie 30 to ensure securing the base tie to the footing 10 while also making sure the notches remain aligned with the chalk lines with the base tie extending perpendicular to the chalk lines.

Figure 5:
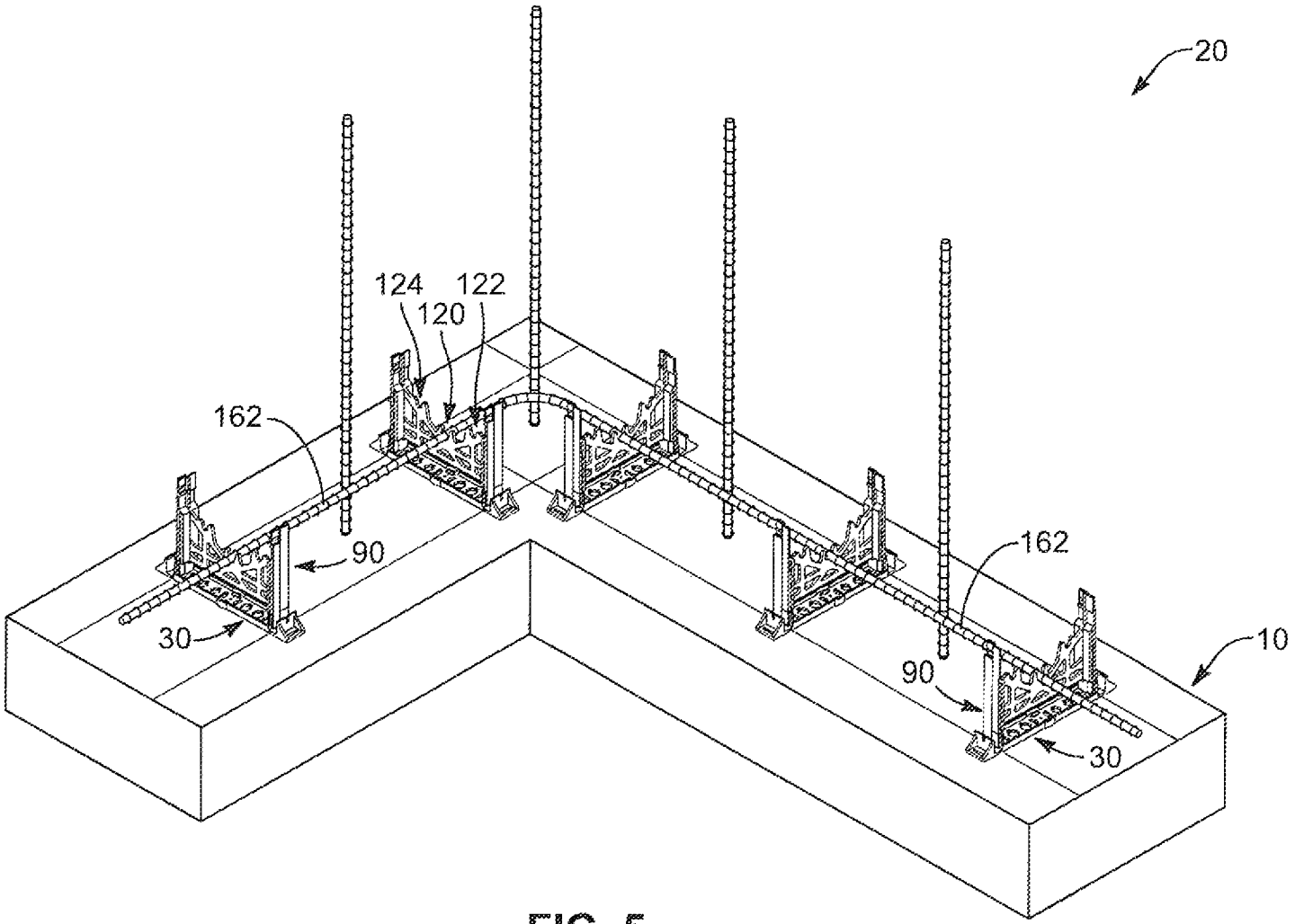
FIG. 5 is a perspective view of the footing with a first course of wall ties attached to base ties on the footing with horizontal rebar positioned over the wall ties, according to the present invention.
Figure 6:
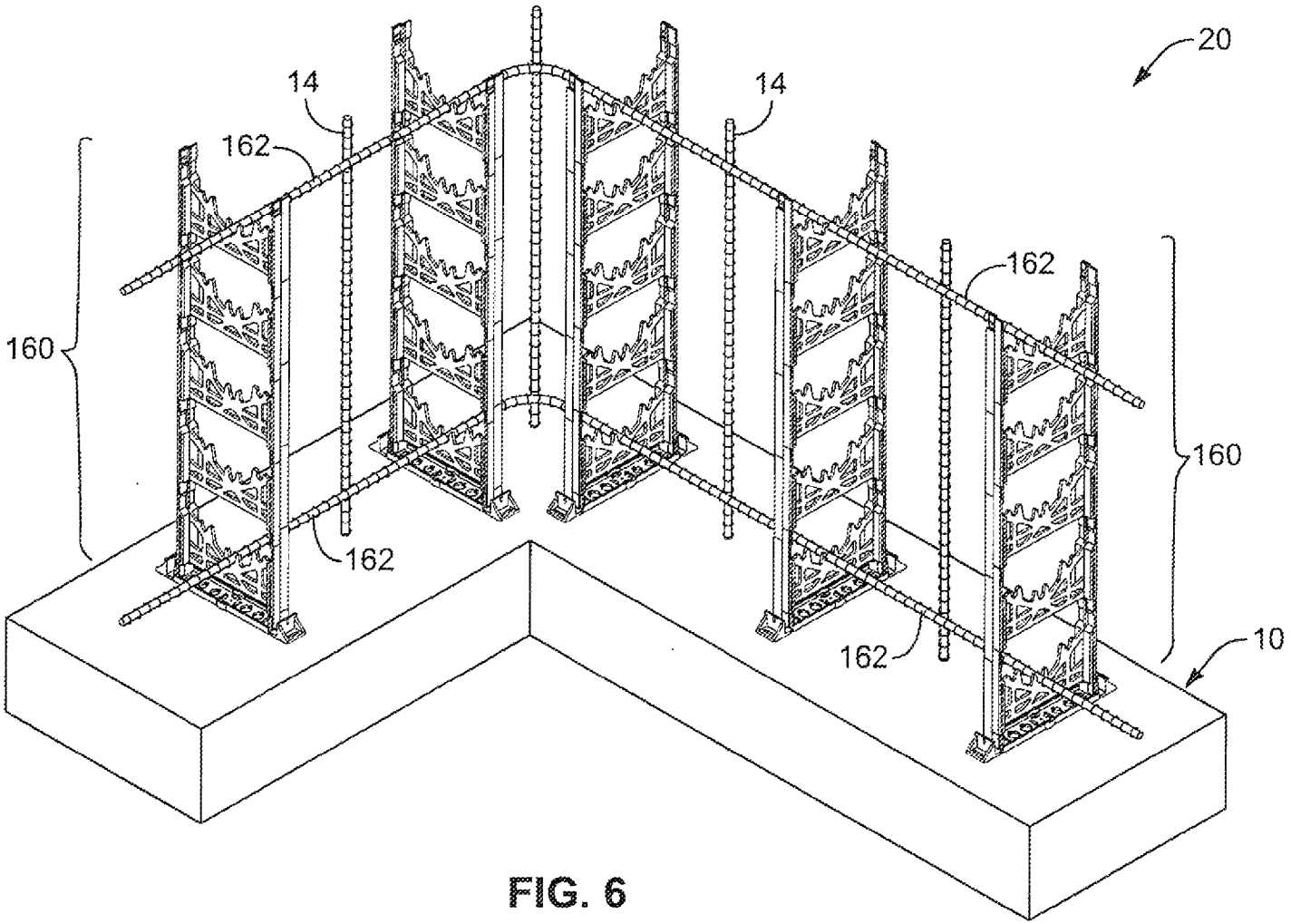
FIG. 6 is a perspective view of the footing with multiple tie stacks and horizontal rebar therewith, according to an embodiment of the present invention.

With reference to FIGS. 5 and 6, there is disclosed a step for building tie stacks 160 of the tie system 20 on the concrete footing 10 with horizontal rebar 162, according to the present invention. In particular, once the base ties 30 are properly secured, a first course of wall ties 90 can be attached to the base ties 30. Such attachment is readily employed by mating the lower attachment portions 130 of a given wall tie 90 with the attachment portion 54 of the base tie 30, as previously set forth herein (See FIGS. 2 and 3). After attachment of the first course of wall ties 90 is complete, it is necessary to determine the desired height for horizontal rebar 162 placement. Typically, it is advantageous and required by code to run a lower level of horizontal rebar 162. As such, once the first course of wall ties 90 are placed, horizontal rebar 162 can be run by placing the rebar within the center rebar holder 120. Each of the rebar holders are sized and configured to maintain the rebate with accurate positioning and with an interference fit. At the center rebar holder 120 level, the horizontal rebar will be approximately 2¾" above the footing. If a slightly different height is required, rebar can be placed along the right or left rebar holders 122 and 124 in each wall tie 90 or rebar can he tied off at different heights along the various portions of the wall tie or tied to the vertical rebar 14. If the design requirements call for two horizontal rebar, such rebar can be positioned in both the right and left rebar holders 122 and 124.

Once the horizontal rebar 162 is positioned along the first course of wall ties, additional wall ties can he added to each stack to the height necessary for running another length of horizontal rebar 162. In other words, depending on the required vertical spacing of the horizontal rebar, the appropriate number of wall ties 90 can be pre-assembled to achieve the desired vertical spacing of such horizontal rebar 162. For example, each wall tie 90 can represent about six inches of vertical height. If your intended rebar spacing between horizontal rebar is twenty-four inches apart, then pre-assemble four wall ties and attached such pre-assembled wall ties to each tie stack before running a second length of horizontal rebar 162. Once such rebar is positioned as desired, additional wall ties 90 can be stacked vertically for each tie stack to the desired height. It should be noted that tie stacks are complete within about five inches of the intended height of the concrete wall. For example, for an intended wall height of three feet, a total of five wall ties will make a complete tie stack 160 with the base tie 30 at the bottom (representing about one inch) providing about five inches below the intended wall height of three feet. As will be readily understood by one of ordinary skill in the art, the ability to internally build the tie stacks 160 with the horizontal rebar 162 prior to positioning the panel structures thereto, as set forth above, provides for quick and ready assembly of the tie system 20, and therefore provides advantages over the prior art in reducing complexity to, thereby, be more time and cost efficient.

Figure 7:
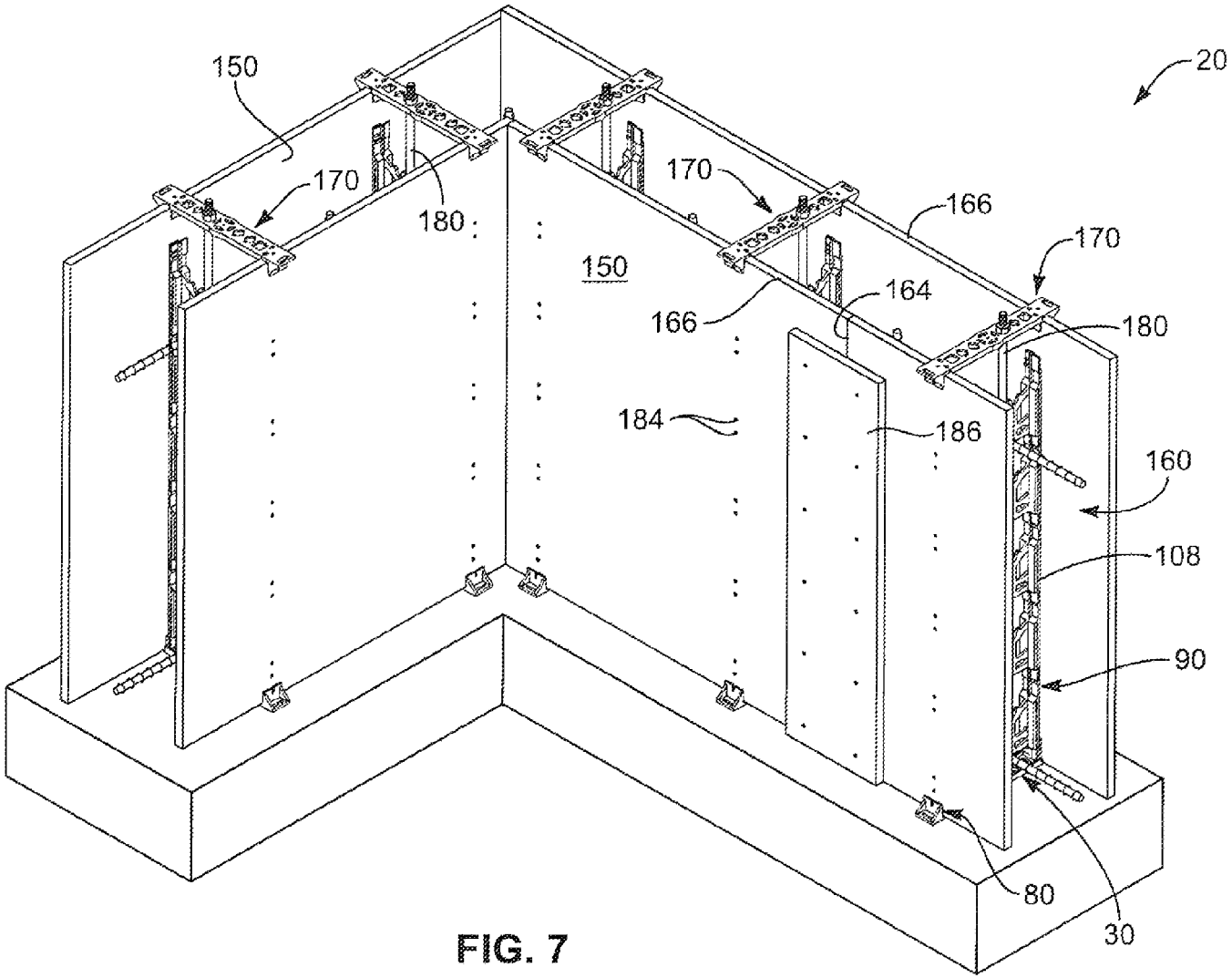
FIG. 7 is a perspective view of the footing with panel structures secured to the wall tie stacks and positioned between base ties and a finish ties, according to an embodiment of the present invention.

Referring now to FIG. 7, there is disclosed a step for attaching the panel structures 150 of the tie system 20 with a finish tie 170, according to the present invention. In particular, panel structures 150 can now he placed within the channel 80 on each side of the base ties 30 so that the panel structures run parallel to each other with each tie stack 160 substantially oriented perpendicular to the panel structures 150, as illustrated. As previously set forth, to ensure optimal concrete walls, i.e., plum and straight, it is important that the thickness and the type of panel structures 150 correspond with the intended wall height and the spacing of the tie stacks, as previously set forth. Further, it is necessary to make sure the seams 164 or butt joints between the plywood panel structures 150 do not correspond with the tie stacks 160. Once such panel structures 150 are placed, base ties can he inverted and placed over a top portion 166 of the panel structures 150 with such top portion 166 positioned and received within the channels of each inverted base tie. The inverted base tie is referred to herein, according to one embodiment, as a finish tie 170. Such finish tie 170 can be configured to interconnect directly to the panel structure 150.

Figure 8:
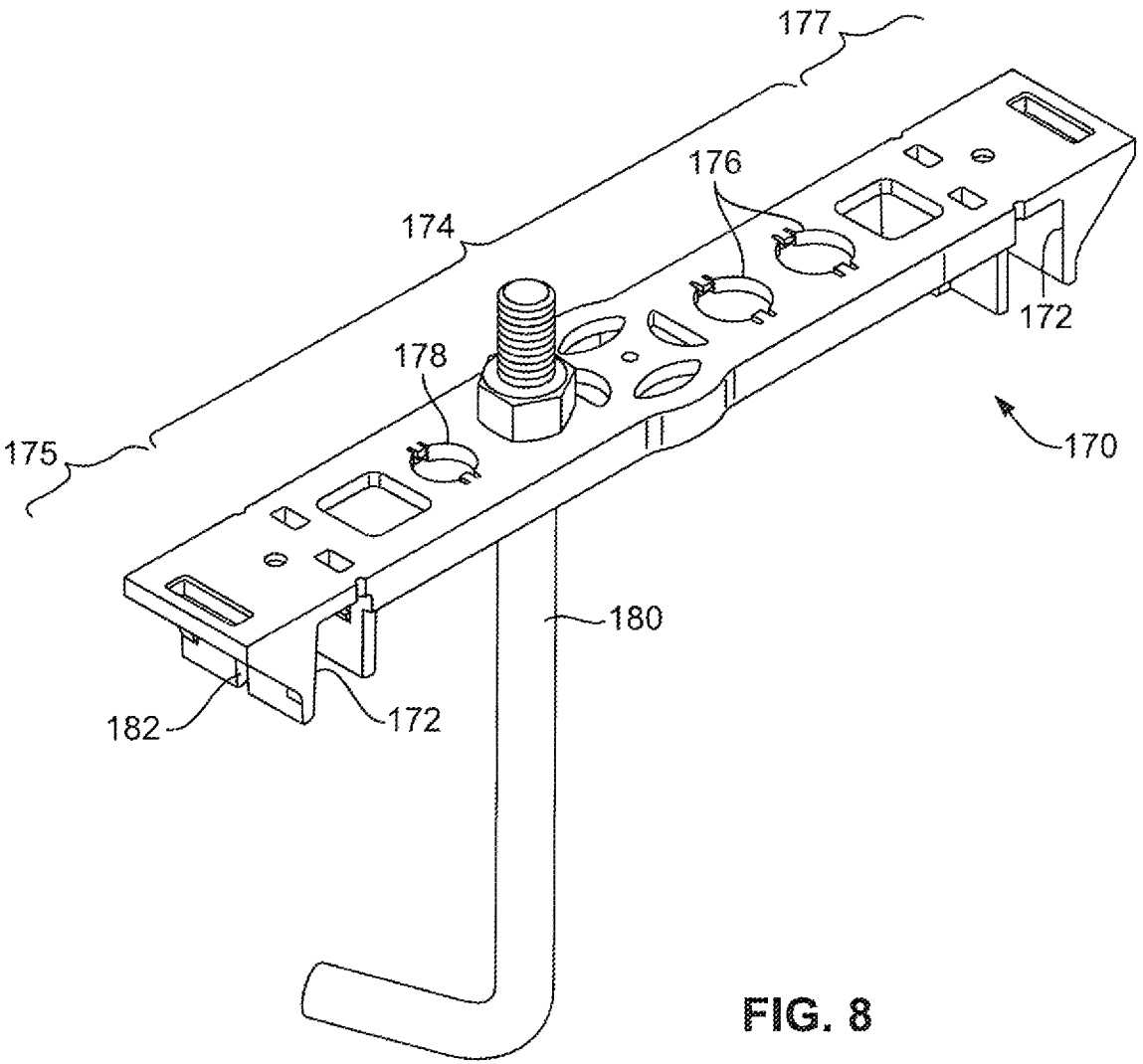
FIG. 8 is a perspective view of the top tie with a anchor bolt coupled thereto, according to one embodiment of the present invention.

With reference to FIGS. 7 and 8, the finish tie 170 includes various sized holes extending through the intermediate portion 174 of such finish tie 170. In particular, there is a pair of ⅝" diameter holes 176 and a pair of ½" diameter holes 178. These holes can be configured to receive and hold an anchor bolt 180. As shown, the anchor bolt 180 can he positioned within one of the holes and secured for subsequent anchoring structure to the top surface of the concrete wall (not shown). For concrete walls having a thickness of 8", the outer holes are center line placement for 2×4 plates and the inner holes are center line placement for 2×6 plates. As such, employing the anchor bolt 180 with the finish tie 170 will provide substantially perfect placement of the anchor bolts 180.

Like the base tie 30, the finish tie 170 can include a first end portion 175 and a second end portion 177 with the intermediate portion 174 extending therebetween. Each of the end portions can define channels 172 therein sized and configured to be positioned over and receive the panel structures 150. Further, channel slots 182 defined in each of the end portions can be employed to fasten the finish tie 170 to the panel structures 150. It should be noted that it is not required to fasten the finish tie 170 to the panel structures 150.

Once the panel structures 150 are positioned within the channels 80 of the base ties 30 and further, the channels 172 of the finish ties 170 are also positioned over the panel structures 150, fasteners 184, such as screws, can be inserted through the panel structures 150 and through the wall ties 90. Placement of such fasteners should correspond with the first and second elongated wall portions 100 and 102 of each wall tie 90 and, more specifically, the intermediate wall portion 108 (See FIG. 2) where the wall tie 90 is thicker than other portions of the wall tie. For more accurate and efficient screw placement, it is preferred to make a template or tool to mark the position for placing screws in the plywood panel structure 150. As depicted in FIG. 7, it is preferred to place two screws through the panel structure 150 and within each side or intermediate wall portion 108 of the wall tie 90. In addition, at the seams 164 or butt joints of the plywood panel structure 150, additional reinforcement should be employed by fastening a scrap piece 186 of plywood over the seem 164 and securing such scrap piece 186 with two vertical rows of screws with about six inches on-center on each side of the seam 164.

FIGS. 9 through 13 disclose additional supporting structures that can be built around the form of the tie system 20 of the present invention. Such additional support structures can be built-up around seems, potential weak portions in the forms or portions that will receive greater loads to ensure the forms will maintain their structural integrity when loaded with the concrete. Further, it is preferred to employ additional supporting structure for any wall height and is required for wall heights three feet and higher.

Figure 9:
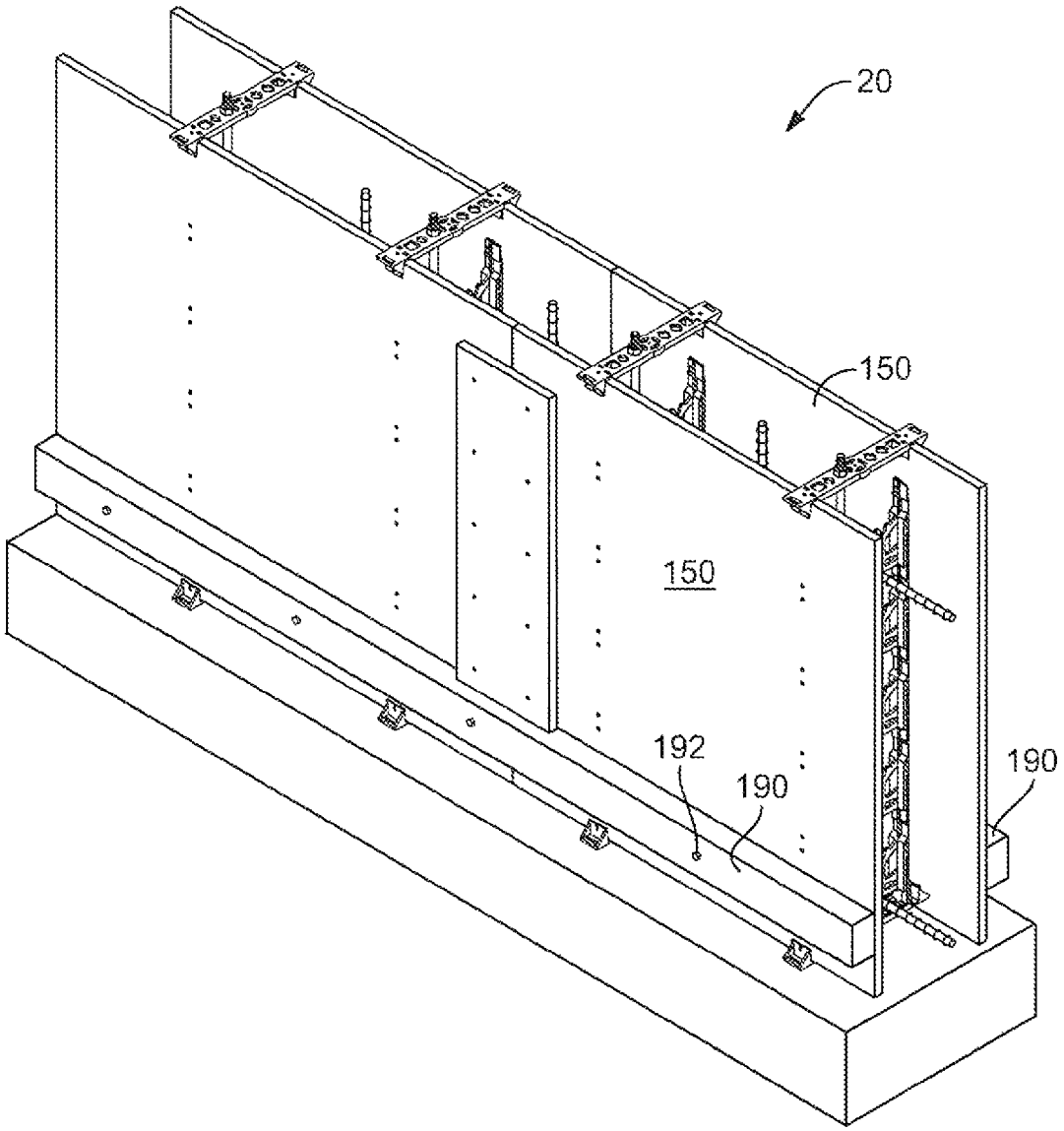
FIG. 9 is a perspective view of the tie system, depicting additional support structure for such system, according to an embodiment of the presents invention.
Figure 10:
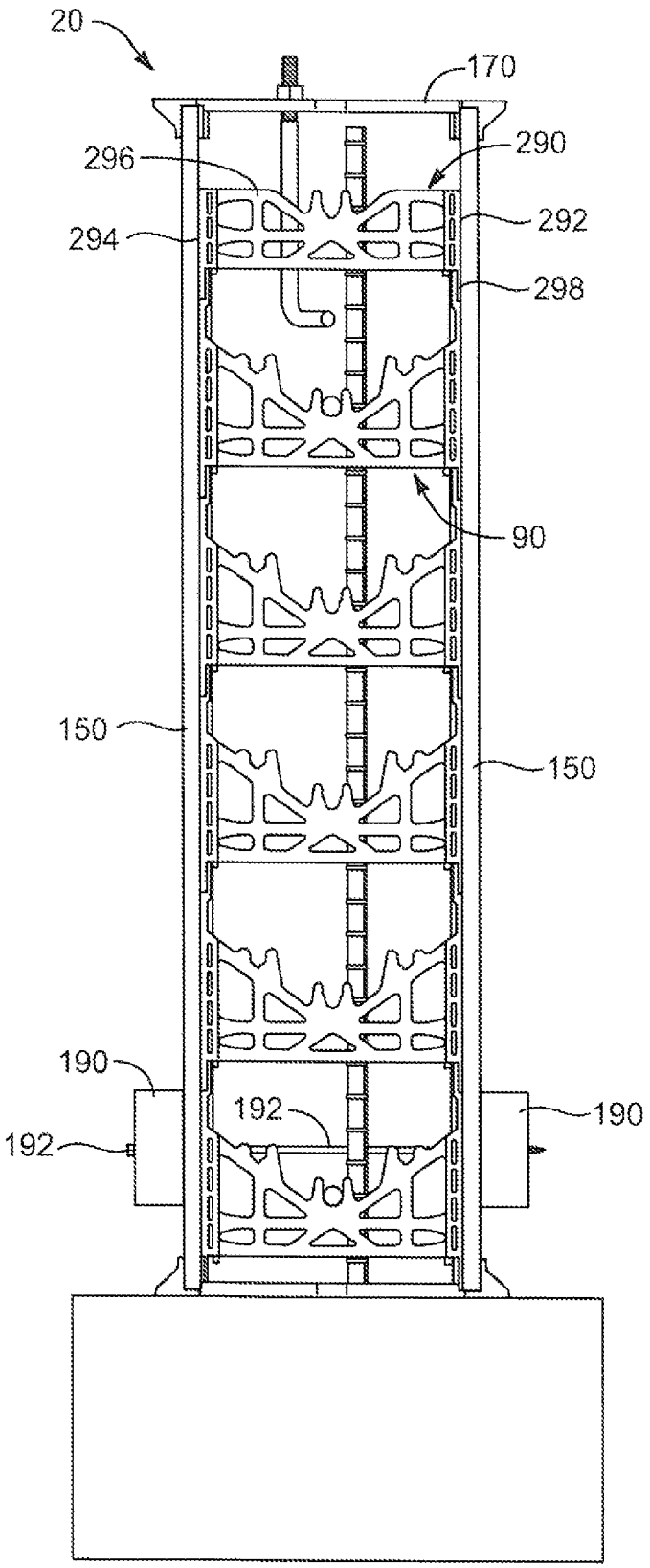
FIG. 10 is a side view of the additional support structure for the tie system depicted in FIG. 9, illustrating an additional top wall tie integrated with the tie system, according to another embodiment of the present invention.

Referring to FIGS. 9 and 10, there is disclosed a lag whaler arrangement in conjunction with the tie system 20 of the present invention. In particular, a 2×4 whaler 190 extends along a bottom portion of both sides of the panel structures 150 with, for example, several 5/16"×15" screws 192 extending laterally through both whalers 190. Such lag whaler arrangement provides additional support to the tie system 20 of the present invention where the forms receive the greatest load pressure, such as, while pouring the concrete with the use of a hydraulic pumping system, to ensure the width of the forms will remain substantially constant and stationary. Once the concrete is poured within the forms, it is important to remove the screws within one to three hours. Removing the lag whaler screws 192 after three hours can make such removal time consuming.

With reference to FIG. 10, there is disclosed additional supporting structure that is internal and integrated with the wall ties in the tie system 20 of the present invention. In particular, in one embodiment, the tie stack can include a top wall tie 290. Such top wall tie 290 is sized and configured to be positioned and attached to a lower all tie 90 and is configured to be the highest tie that is directly interconnected to other ties in the tie stack in the tie system 20. The top wall tie 290 can include a similar profile as the wall tie 90, except the top wall tie 290 can extend approximately three to four inches in vertical height, rather than the six inches of the wall ties 90. As such, the top wall tie 290 can include a first elongated wall portion 292 and a second elongated wall portion 294 with a cross-member 296 extending therebetween. Further, the top wall tie 290 can include a lower attachment portion 298 at a lower end of each of the first elongated wall portion 292 and the second elongated wall portion 294. The lower attachment portion 298 of the top wall tie 290 is sized and configured to attach to the upper attachment portion 140 of the wall tie 90 (See FIG. 2). Such top wall tie 290 can provide internal support, in addition to the finish tie 170, to the tie system 20 at an upper portion of the panel structures 150. Similar to the wall ties, the top wall tie 290 is sized and configured to be disposed between the panel structures 150 and is configured to be fastened to and between the panel structures.

Figure 11:
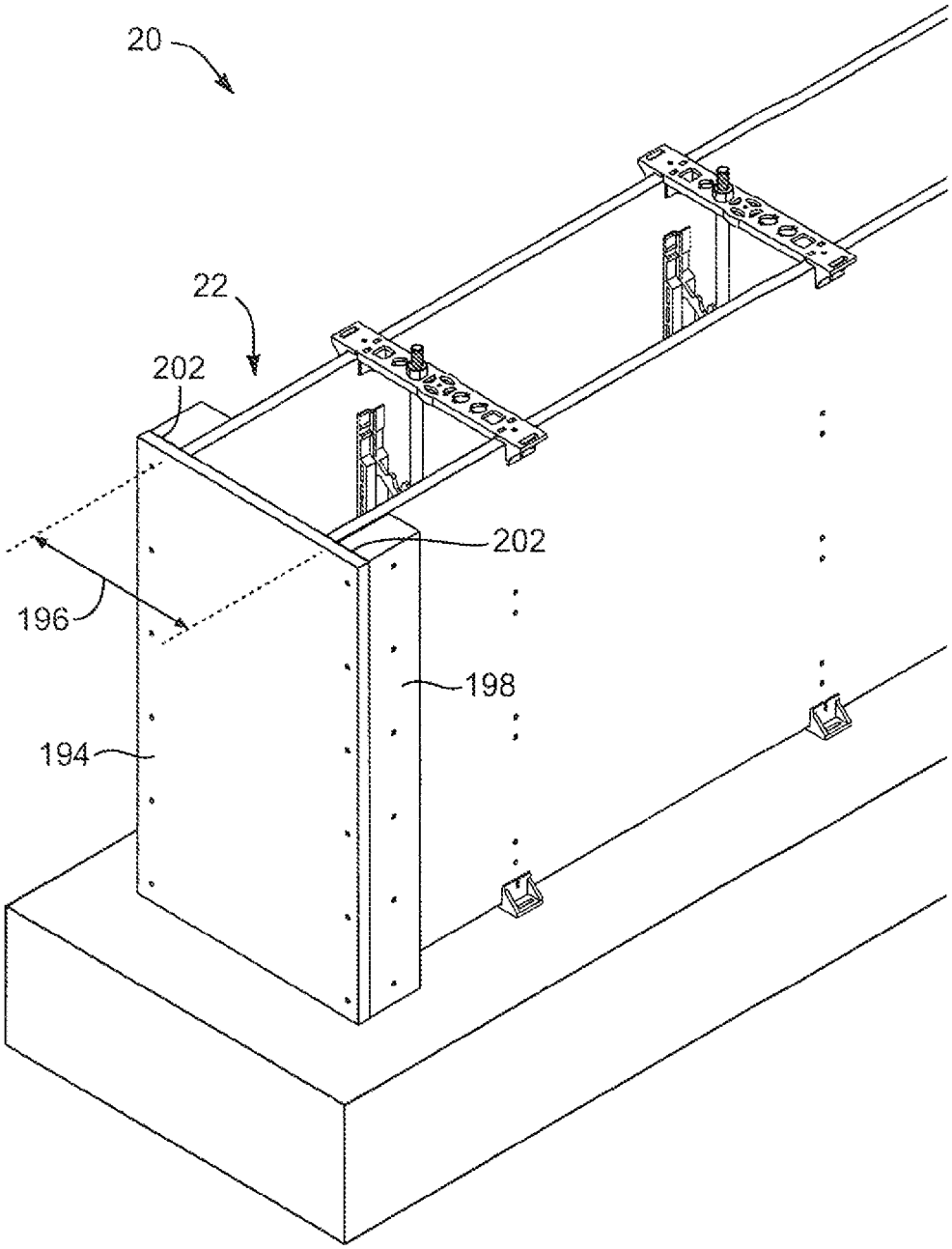
FIG. 11 is a perspective view of another embodiment of additional support structure for a wall end, according to the present invention.

FIG. 11 discloses an end portion 22 of the tie system 20, according to another aspect of the present invention. Additional supporting structure can be built for end portions 22 by simply having an end sheet 194 of plywood be cut wider, such as about three inches wider, than a width 196 of the parallel plywood panel structures 150 and securing two 2×4 beams 198 vertically to an inside edge 202 of the wider end sheet 194, as depicted.

Figure 12:
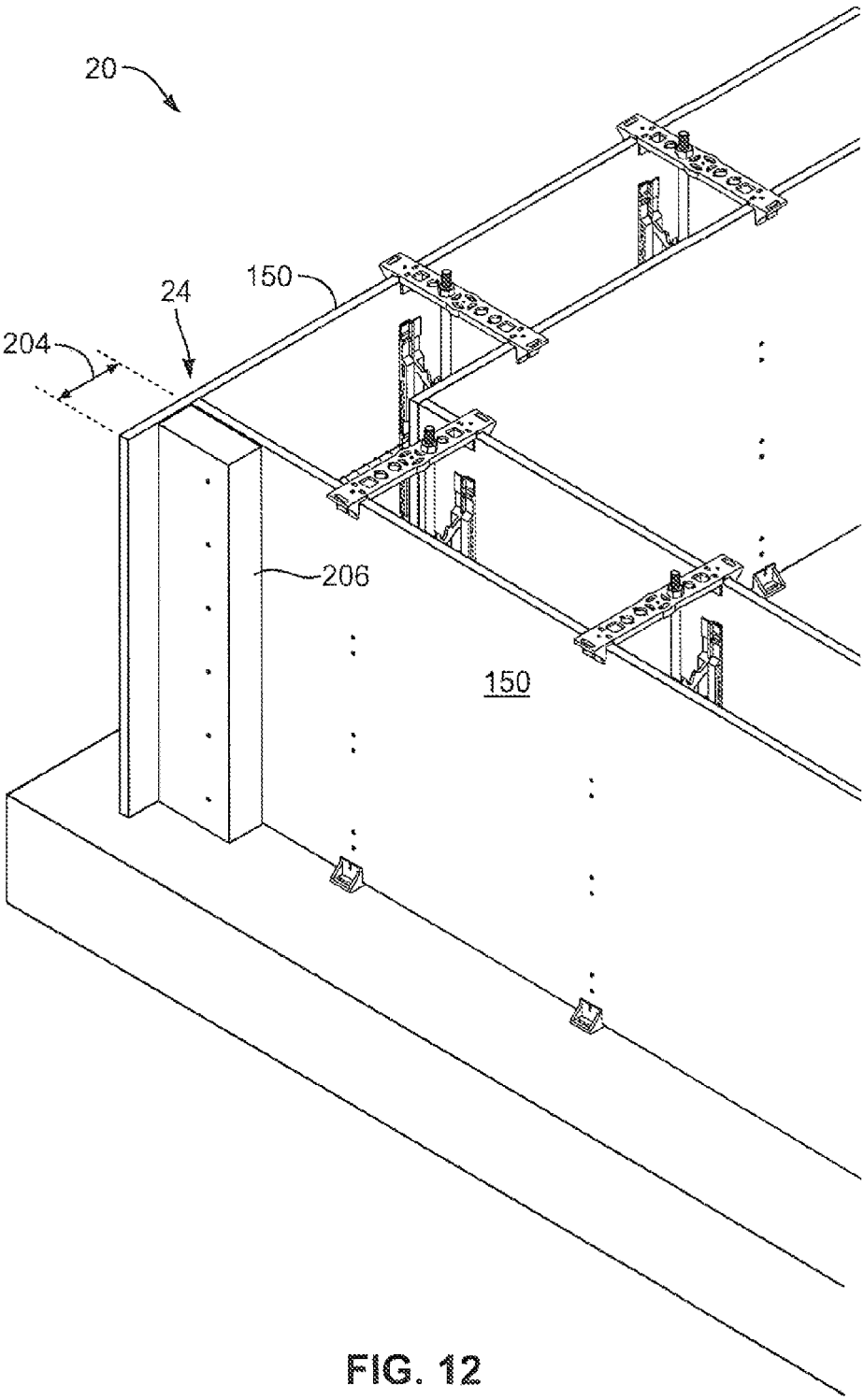
FIG. 12 is a perspective view of additional support structure for a wall corner, according to one embodiment of the present invention.

Referring now to FIG. 12, additional supporting structure can also be employed for outside corners 24 of the tie system 20, according to the present invention. In particular, for an outside corner 24, one of the panel structures can extend a longer length 204, such as about three inches, and then fasten a 2×4 beam 206 vertically to both intersection panel structures 150, as depicted. It one cannot extend the plywood panel structure 150 longer a given distance, the corner can be wrapped with two 2×4 beams 208 extending vertically, as depicted in the outside corner 24 of the tie system 20 in FIG. 13. For inside corners, no additional support is needed up to a three foot wall height. For inside corners taller than three feet, the outside corner detail can be inverted by fastening a 2×4 beam vertically to the two intersecting inside corner panels.

Figure 13:
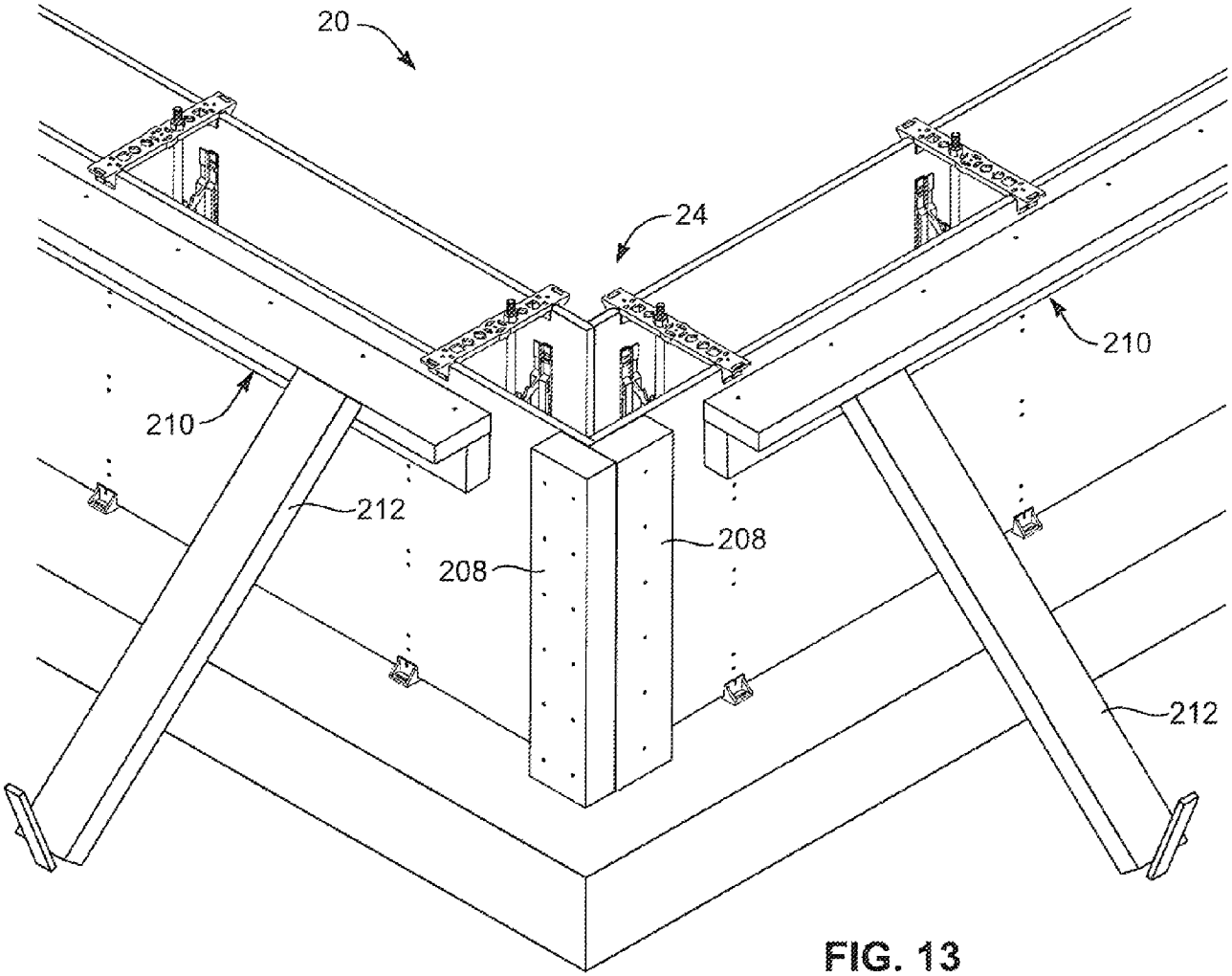
FIG. 13 is a perspective view of additional support structure for a wall corner, according to another embodiment of the present invention.

FIG. 13 also discloses another embodiment for attaching additional supporting structure along a length of an upper portion of the tie system 20 to keep the mall straight and plum, according to another aspect of the present invention. In particular, additional support structure can be provided to the concrete form by securing 2×4 beams 210 horizontally along an upper portion of the concrete forms and positioning beams 212 to extend between the ground and the horizontally extending beams in a diagonal manner, as depicted.

Figure 14:
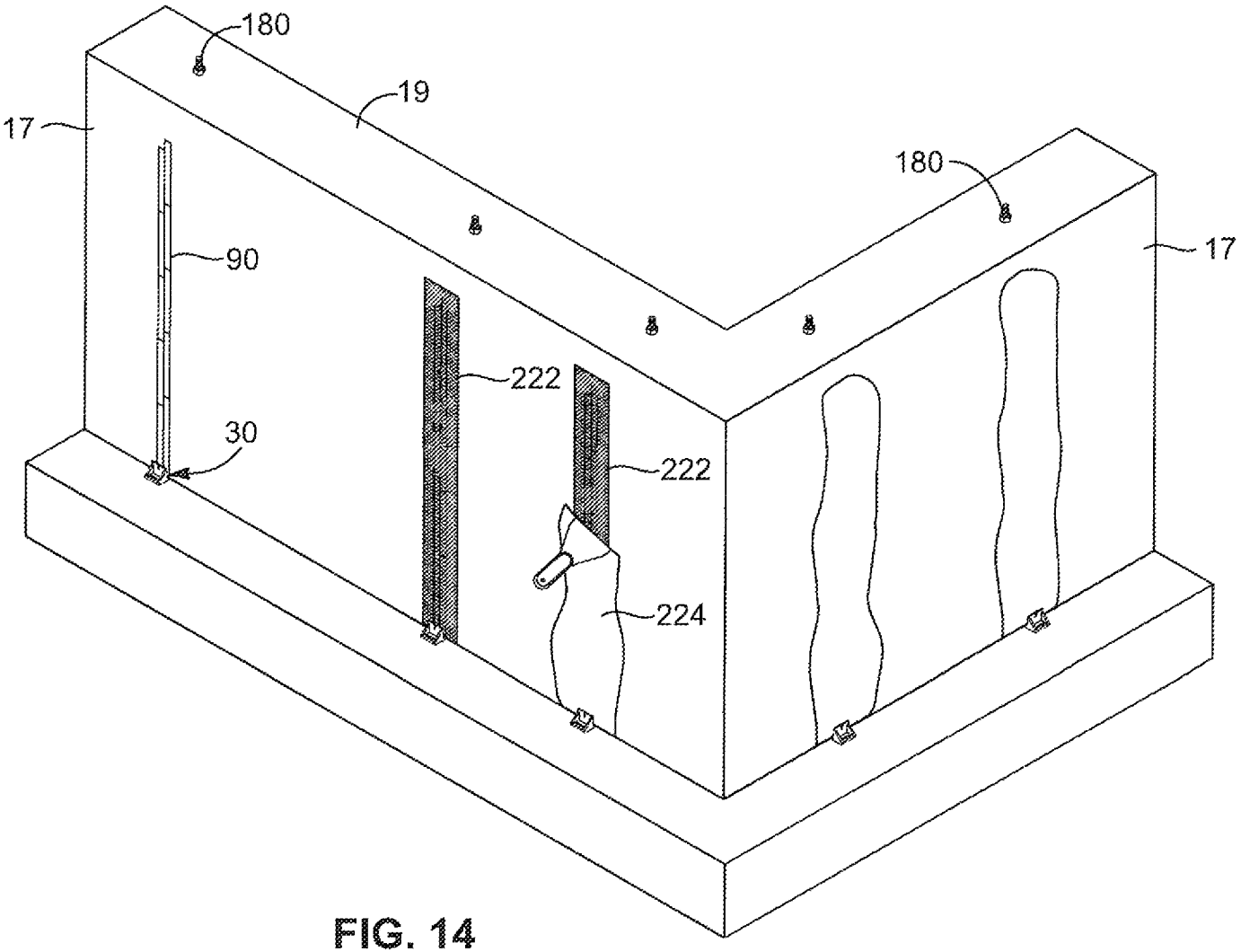
FIG. 14 is a perspective view of an exposed concrete wall after the panel structures are removed, depicting a covering and coating process of an exposed portion of the wall ties, according to an embodiment of the present invention.

Referring now to FIG. 14, there is disclosed a step for covering and coating an exposed portion of the wall ties in an exposed and hardened concrete wall 17, according to another aspect of the present invention. Once the forms have been built and provided the proper supporting structure, the concrete can be poured between the forms and left to set and, as previously set forth, within one to three hours, the screw from the lag whaler arrangement can be removed from the forms. Once the concrete is completely set, the forms can be removed, including the additional support structure, the panel structures and the finish ties. According to another advantageous aspect of the present invention, the panel structures and finish ties can then be re-used for another tie system or the panel structures can be employed for other portions of the residential or commercial building, such as for the roof or sub-floor. Therefore, the tie system of the present invention limits the waste of lumber and maximizes the use of materials.

As shown, a top portion 19 of the hardened concrete wall 17 can include an exposed portion of the anchor bolts 180 ready to receive the bottom portion of the structure (not shown) to be built thereon. Also, once the panel structures are removed, the outer surface of the wall ties 90 will be exposed on the concrete wall 17 along with a portion of the end portions of the base tie 30. To cover this exposed portion of the wall tie 90, a self-adhesive tape 222 can be applied thereto, such as a mesh tape. The self-adhesive tape 222 can then receive a base coat product 224. The base coat product can be any suitable exterior insulation finishing system ("E.I.F.S.") type product, such as, DRYVIT, PAREX, SYNERGY or FINESTONE products. This will provide a bridge over the exposed wall ties that provides a surface that can be plastered over or receive a water proofing product as typically employed on foundation walls.

Furthermore, in another aspect of the present invention, once the panel structures are removed from the hardened concrete wall 17, the exposed portion of the wall ties 90 can be used as anchoring points for other building materials. In particular, such exposed portion of the wall ties 90 in the concrete wall can be employed as a substrate to anchor a polymeric insulation building material thereto. The portion best suited to anchor into is the intermediate wall portion 108 being sized and configured thicker than other portions of the elongated wall portions (See FIG. 2). Polymeric building materials can include, but are not limited to, high density polystyrene foam, or any other suitable polymeric foam or building material typical to that used in insulation concrete forms. Of course, the exposed portion of the wall ties 90 can also be used to anchor other types of materials as well. In this manner, the tie system of the present invention can be employed to form concrete walls and obtain the advantages of an insulated wall without the high cost of the insulation concrete form systems.

Figure 15:
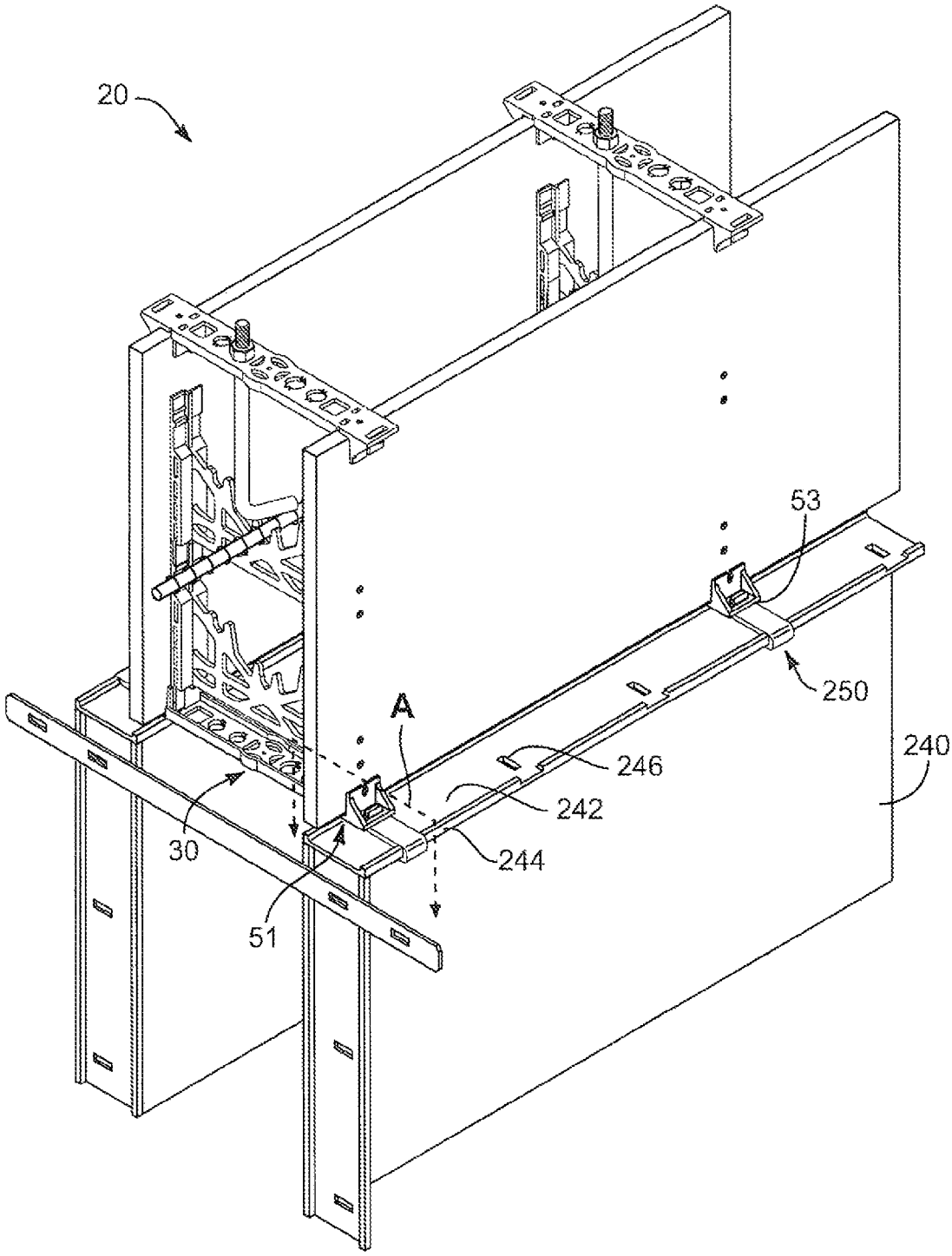
FIG. 15 is a perspective view of the tie system being utilized over traditional metal concrete forms, depicting a clip member interconnecting the metal concrete forms to the tie system, according to an embodiment of the present invention.
Figure 16:
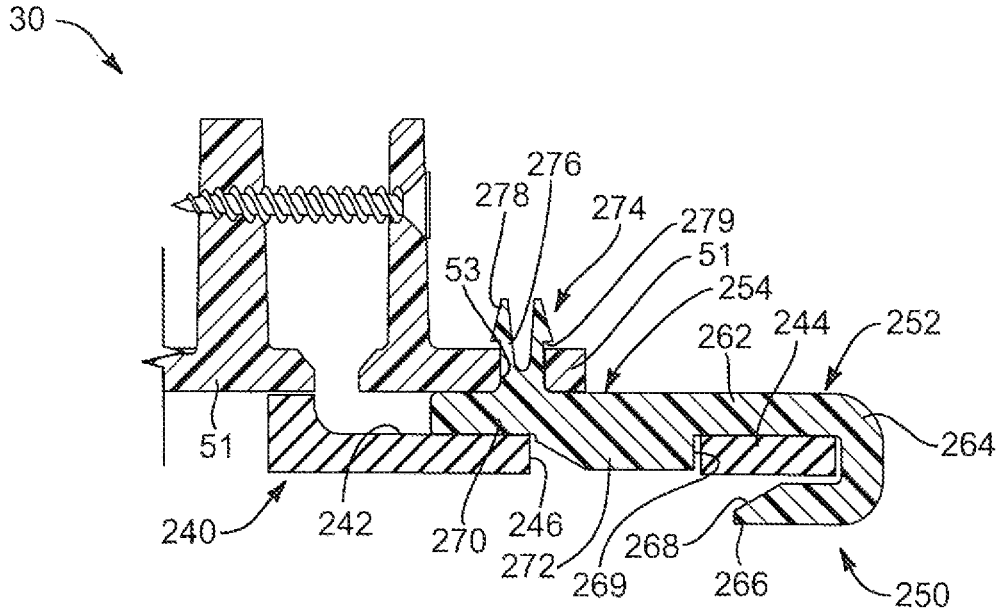
FIG. 16 is cross-sectional view, taken along line A, of the tie clip member and a portion of the base tie, depicting the clip member fastened to metal concrete forms, according to the present invention.

FIGS. 15 and 16 disclose another embodiment of the tie system 20 in conjunction with a clip member 250, according to the present invention. In particular, there is disclosed a clip member 250 that can be integrated with the base tie 30 of the present invention and attach to a top surface 242 of traditional metal forms 240. Such a clip member 250 can be employed with the tie system 20 of the present invention for increasing the height for a concrete wall than that which is available for a given metal form system.

The clip member 250 can include a form attachment portion 252 and a tie attachment portion 254. The form attachment portion 252 is sized and configured to attach to a portion, such as a top surface 242, of the metal forms 240. The form attachment portion 252 can include a first extension portion 262, a wrap portion 264 and a free end 266. The first extension portion 262 can be configured to extend outward from the tie attachment portion 254 to the wrap portion 264. The wrap portion 264 can be sized and configured to wrap around an edge 244 at the top surface 242 of the metal form 240. The free end 266 extends from the wrap portion 264 and can include a tapered lip 268. At an underside of the first extension portion 262, there is defined a recess 269 or groove configured to receive the edge 244 of the metal form 240 in conjunction with the wrap portion 264. With this arrangement, the clip member 250 can be readily attached to the edge 244 of the metal form by pulling and sliding the tapered free end 266 under the edge 244 and into the wrap portion 264 until the recess 269 of the first extension portion 262 engages such edge 244.

Now with reference to the tie attachment portion 254 of the clip member 250, such tie attachment portion 254 can be sized and configured to attach to a clip hole 53 in an end portion 51 of the base tie 30. The tie attachment portion 254 can include a second extension portion 270 with a clipping portion 274 extending upward therefrom and a lower portion 272. The second extension portion 270 is sized and configured to be disposed between a top surface 242 of the metal forms 240 and below the base tie 30. The clipping portion 274 can be sized and configured to extend through the clip hole 53 defined in the end portion 51 of the base tie 30. The lower portion 272 below the second extension portion 270 can be disposed within a hole 246 defined in the top surface 242 of the metal forms 240. The clipping portion 274 can include two upward extending portions 276 each with a tapered free end 278 and a back-stop 279. As such, once the clip member 250 is properly positioned and attached to the metal forms 240, the base tie 30 can be aligned such that the clipping portion 274 is inserted through the clip hole 53 in the base tie 30. As such insertion takes place, the tapered free ends 278 of the upward extending portion 276 squeeze or move together until the clipping portion 274 is fully inserted. The back-stop portion 279 of each upward extending portion 276 maintains the base tie 30 in proper position. Another clip member 250 should also be employed, as previously set forth, for the opposite side of the base tie 30 and each base tie 30 along the length of the metal forms 240. In this manner, the clip member 250 can be utilized with the tie system 20 to achieve greater concrete wall heights than that which is available for a given metal form 240. It should be noted that the base tie, in this aspect of the present invention, is positioned over the concrete footing (not shown) and more specifically, is positioned over and above the concrete footing while being secured to the metal forms 240.

Furthermore, the tie system of the present invention can also be employed over a top portion of traditional wood forms, similar to that depicted in the previous embodiment. However, according to another embodiment, the base tie 30 can be positioned over (and above) the footing and fastened to the top surface of traditional wood forms via a base securing hole 83 defined in each of the channels 80 of the first end portion 50 and the second end portion 52 of the base tie 30, as depicted in FIGS. 2 and 2A. As will be readily understood by one of ordinary skill in the art, the base tie 30 can be positioned and secured on the top surface of the traditional wood forms via base securing hole 83 and, then built upon with the tie system, as set forth herein.

Figure 17:
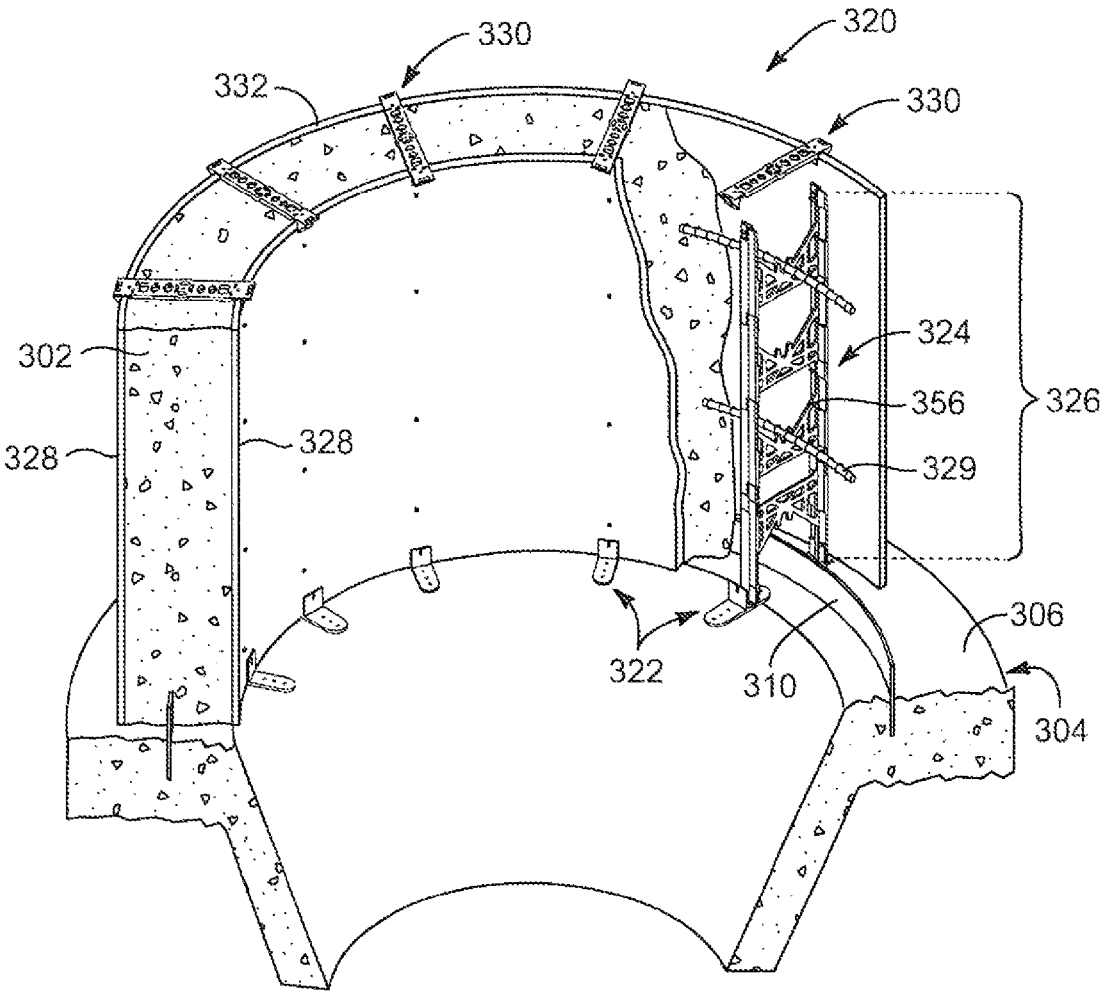
FIG. 17 is a perspective view of a tie system between panel structures, with portions removed, for forming a wall for a swimming pool, depicting the tie system being used along a curved footing to form a curved wall, according to one embodiment of the present invention.

With respect to FIG. 17, another embodiment of a tie system 320 utilized for forming a concrete wall 302 on a footing 304 made, for example, a swimming pool is shown. The tie system 320 of this embodiment may be employed in conjunction with a water stop 310. The water stop 310 may be positioned within a top surface 306 of the footing 304, extending lengthwise along a curvature of the footing 304 or along a linear footing, as the case may be. The water stop 310 may be positioned and embedded into the footing 304 before the footing is hardened and provides one means for preventing water from seeping between the footing 304 and the finished concrete wall 304. The water stop 310 may be about six to eight inches in height, but is not limited to such, with about half the height embedded into the footing 304. As such, the tie system 320 of this embodiment may be employed for walls where the water stop 310 is preferred, such as for forming walls of a swimming pool, a storm drain, or any other wall structure made to hold a liquid. Furthermore, it should be noted that the tie system 320 of this embodiment, as well as the tie system of the previous embodiments, such as the tie system depicted in FIG. 1, may be employed along a footing with a radius to form walls with a corresponding wall radius.

Similar to the previous embodiments, the tie system 320 may include base members 322 and wall ties 322 interconnected together to form multiple tie stacks 326 that are spaced apart and secured to and along the footing 304. The tie stacks 326 can be built in levels to readily facilitate laying or positioning rebar 329 over appropriate levels within the tie stacks 326. With multiple tie stacks 326 secured to the looting 304, panel structures 328 can be secured to the tie stacks 326 and finish ties 330 may be secured to an upper end 332 of the panel structures 328. The panel structures 328, in the case of the curved footing, may be positioned and secured to the tie stacks 326 by bending or bowing the panel structures 328 as they are secured to the tie stacks 326. The panel structures 328 employed with the curved footing may be bendable plywood, masonite or plastic panels that will provide sufficient strength to act as a temporary form, but also may readily bow or bend, as known to one of ordinary skill in the art. At this stage, the hardenable building material, such as concrete or any other hardenable building material, can be poured between the panel structures 328. Once the hardenable building material has cured sufficiently, the panel structures 328 and finish ties 330 can be removed, leaving the newly formed concrete wall 302.

Figure 18:
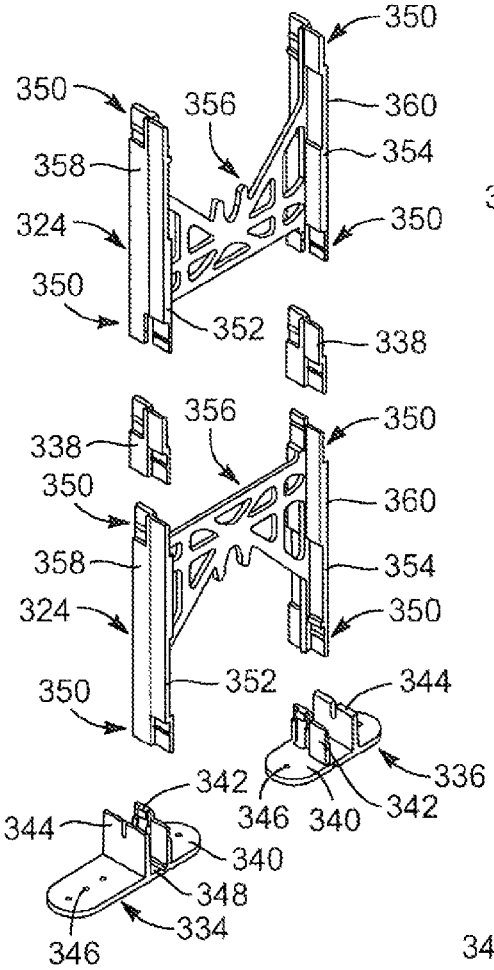
FIGS. 18 and 19 are respective exploded and assembled perspective views of some of the components of the tie system, according to another embodiment of the present invention.
Figure 19:
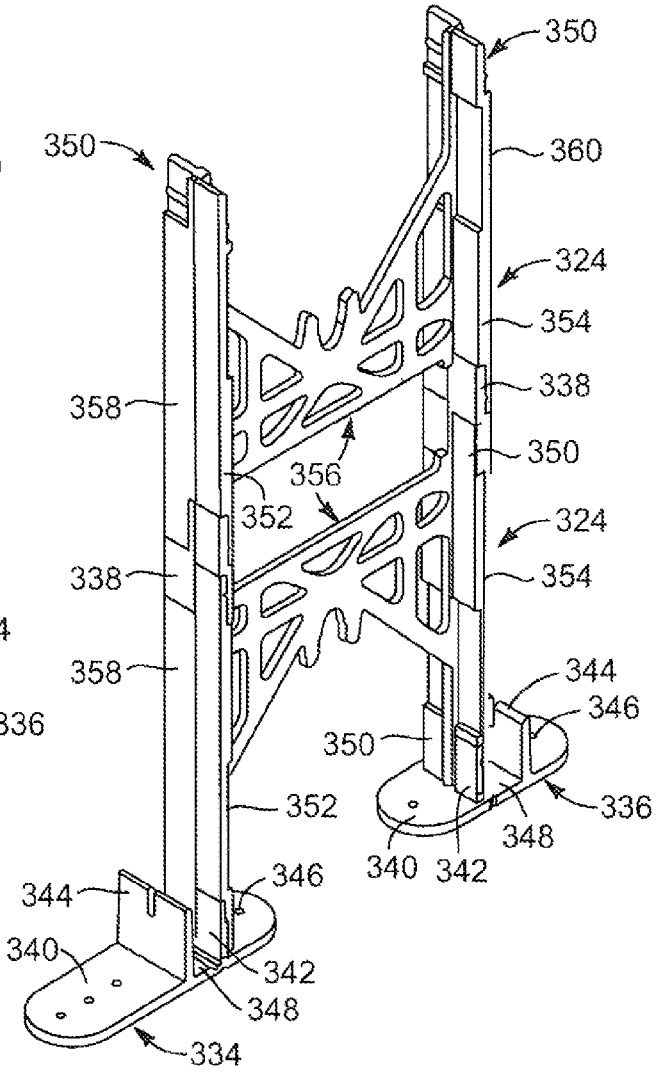

Referring now to FIGS. 18 and 19, some of the components of the tie system 320 depicted in FIG. 17 are shown in respective exploded and assembled views. This embodiment is similar, in most respects, to the embodiment depicted in FIG. 2, but with different base members 322. In one embodiment, the base members 322 may facilitate the tie system 320 being secured to the footing and assembled over the water stop 310 embedded in the footing 304 (see FIG. 17). Such base members 322 may include a first base portion 334 and a second base portion 336 and multiple wall ties 324. Also, the tie system 320 may include intermediate adapters 338.

The first base portion 334 and the second base portion 336 may be separate and discrete components from each other. That is the first base portion 334 and the second base portion 336 may be discrete structures in the unassembled form, but may be configured to be interconnected once the wall tie 324 is attached to the first and second base portions 334, 336. Each of the first base portion 334 and the second base portion 336 may include a base extension 340 and one or more upstanding attachment portions 342 and a support wall 344. The base extension 340 may be configured to be secured to a toting and configured to extend horizontally against the footing with the upstanding attachment portions 342 and support wall 344 extending vertically from and relative to the footing and base extension 340. Such first and second base portions 334, 336 may be secured to the footing via concrete fasteners at the multiple holes 346 extending through the base extension 340.

The upstanding attachment portions 342 of the first and second base portions 334, 336 may be configured to connect or mate with the respective end portions of the wall tie 324, similar to previous embodiments. The support wall 344 may extend upward to the height of the upstanding attachment portion 342 or to a height beyond the upstanding attachment portion 342. The upstanding attachment portion 342 and the support wall 344 may define a channel 348 therebetween, the channel 348 sized and configured to receive a bottom end of the panel structures 328 (FIG. 17).

The wall tie 324 may be similar to the wall ties described in earlier embodiments, though, in part, interconnect differently. For example, in this embodiment, the wall tie 324 may be interconnected to the first and second base portions 334, 336 in an inverted manner such that two end portions 350 of the wall tie 324 mate with the respective upstanding attachment portions 342 of the first and second base portions 334, 336. As in the previous embodiments, the wall tie 324 may include a first elongated wall portion 352 and a second elongated wall portion 354 with a cross-member portion 356 extending therebetween. The end portions 350, of both an upper end and lower end of the wall tie 324, of each of the first and second elongated wall portions 352, 354 may be sized and configured to mate or interconnect with at least one of the first and second base portions 334, 336, another wall tie 324 and the intermediate adapter 338. In this embodiment, the wall tie 324 may be inverted such that the corresponding end portions 350 of the first and second elongated wall portions 352, 354 mate and attach with the attachment portions 342 of the first and second base portions 334, 336.

The intermediate adapters 338 may be connected to the end portions 350, on the upper end, of the first and second elongated wall portions 352, 354 of the inverted wall tie 324. Such intermediate adapters 338 may be employed to facilitate an additional wall tie 324 to be interconnected thereto, attachable in a non-inverted or upright manner. In this manner, additional wall ties 324 may be attached and stacked in an upright non-inverted orientation to vertically build the tie stack 326 to the height desired.

As in the previous embodiments, each tie stack 326 may include multiple wall ties 324, with the inverted bottom wall tie 324 secured to one or more base members 322 or, more specifically, the first and second base portions 334, 336. Each tie stack 326 extends vertically relative to the footing, curved or linear, with the first and second elongated all portions 352, 354 for each wall tie 324 including a first flat surface 358 and a second flat surface 360, the first flat surface 358 facing directly opposite the second flat surface 360. Further, the first flat surface 358 and the second flat surface 360 of respective first and second elongated wall portions 352, 354 extend longitudinally vertical and perpendicular relative to the base members 322. It should also be noted that the intermediate adapters 338, interconnected between the inverted wall tie 324 and another wall tie that is upstanding, also are configured to include a flat outward facing surface that may be flush and correspond with the first and second flat surfaces 358, 360 of the first and second elongated wall portions 352, 354. Such first and second flat surfaces 358, 360 of the tie stack 326 may be configured to be directly secured to the panel structures 328, as depicted in FIG. 17. With this arrangement, the panel structures 328, secured to the first and second flat surfaces 358, 360 of each tie stack 326, provides the forms for pouring the hardenable building material, such as concrete, over the tie system 320 securing the panel structures 328, or forms, in position.

Figure 20:
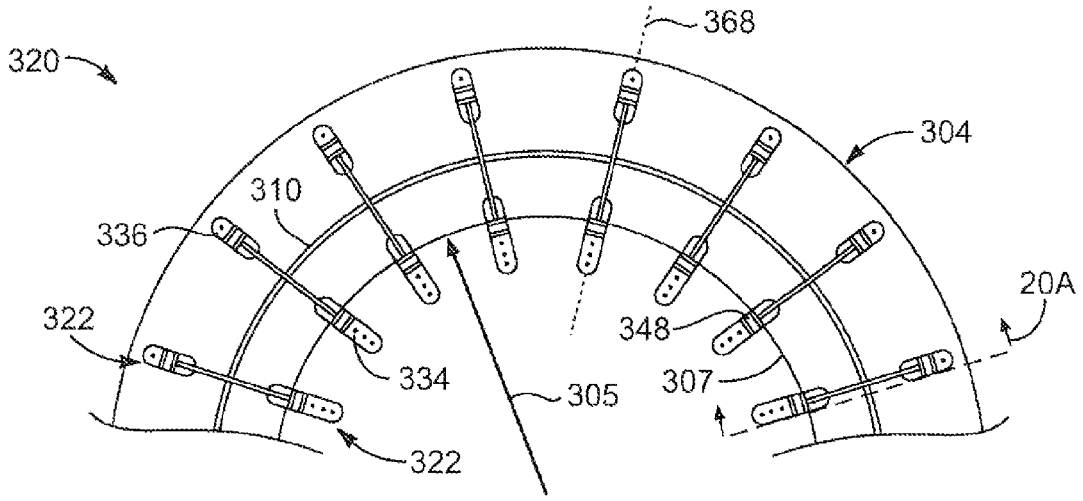
FIG. 20 is a top view of a footing with a radius, depicting multiple base members and wall ties positioned on the footing, according to another embodiment of the present invention.
Figure 20A:
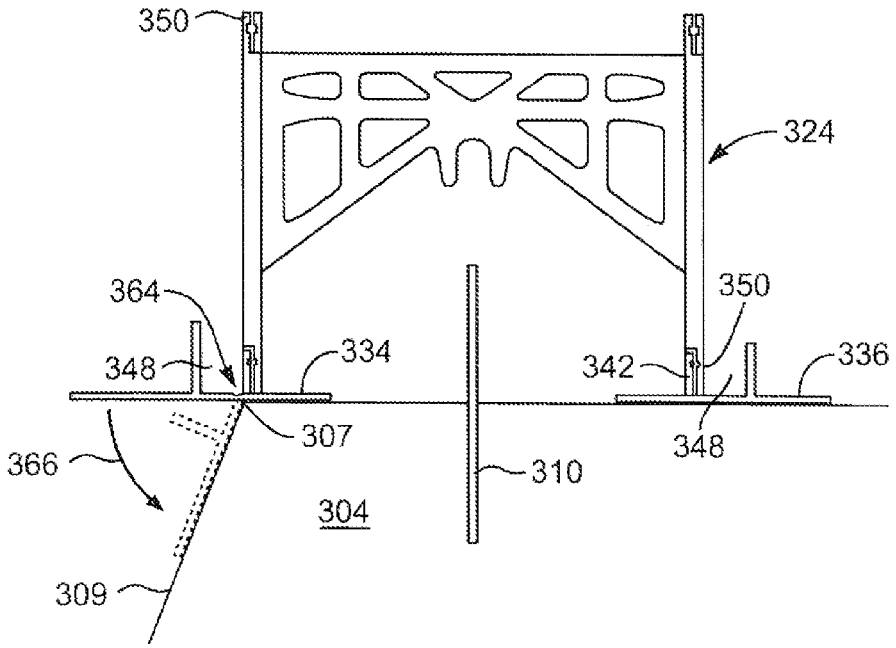
FIG. 20A is a cross-sectional view taken from segment 20A of FIG. 20, depicting one of the base portions being bendable over a side of the curved footing, according to another embodiment of the present invention.

With respect to FIGS. 20 and 20A, multiple base members 322 and wall ties 324 positioned over a footing 304 with a radius 305 are depicted. The multiple base members 322 or first and second base portions 334, 336 of the tie system 320 are positioned in a spaced apart arrangement and oriented lengthwise to extend along and substantially align with the radius 305 of the footing 304. Further, the first and second base portions 334, 336 may be secured to the footing and spaced a distance from each other so that the attachment portion 342 can mate with the end portions 350 of the wall tie 324. To ensure appropriate spacing between the first and second base portions 334, 336, the inverted wall tie 324 may be attached to such base portions as the base portions 334, 336 are secured to the footing. Further, the first base portions 334 may be positioned such that the attachment portion 342 is adjacent to or aligns with an edge 307 of the footing 304 such that the channel 348 may partially extend over the edge 307 of the footing 304. In addition, the second base portion 336 may be aligned with the first base portion 334 a specific distance such that the attachment portions 342 will correspond with the end portions 350 of the wall tie 324. Further, the first base portion 334 and the second base portion 336 may be positioned on the footing such that the water stop 310 extends therebetween with the inverted wall tie 324 providing the clearance for the water stop 310. More specifically, in instances where the tie system 320 is utilized for forming walls for a swimming pool or the like, the water stop 310 may he positioned and embedded within the footing 304 with the fast and second base portions 334, 336 on an inner and outer side of the water stop 310 so that each tie stack 326 is positioned over the water stop 310 (also seen in FIG. 17).

In another embodiment, the first base portion 334, as previously indicated, may hang over the edge 307 of the footing 304. The first base portion 334 may include a thinned portion 364. The thinned portion 364 may readily allow the overhanging portion of the first base portion 334 to be bendable or moveable against a side wall 309 (or sloping surface) of the footing 304 and to be secured thereto, as shown by arrow 366. In this manner, the bottom end of the panel structures 328, as shown in FIG. 17, can be positioned substantially adjacent and flush with the edge 307 of the footing 304 and against the first and second elongated wall portions 352, 354 of the wall ties 324 so that the wall formed between the panel structures 328 sits flush and extends to the edge 307 of the footing 304.

Referring now to FIGS. 17, 19 and 20, each of the cross-member portions 356 of the tie stack 326 may extend generally in a common plane 368. Such common plane 368 of the cross-member portions 356 may be configured to be substantially perpendicular to the top surface 306 of the footing 304 (as well as the base extension 340 of each of the first and second base portions 334, 336) and substantially perpendicular relative to the first and second flat surfaces 358, 360 of the first and second elongated wall portions 352, 354 of the wall ties 324. With this arrangement, the substantially perpendicular relationship of the cross-member portions 356 (being generally in a common plane) in each tie stack 326 relative to the first and second flat surfaces 358, 360 and the top surface 306 of the footing 304 or base extensions 322 may maximize the structural integrity of the tie stack 326 when receiving the weight associated with the hardenable building material, or concrete, between the panel structures 326.

Figure 21:
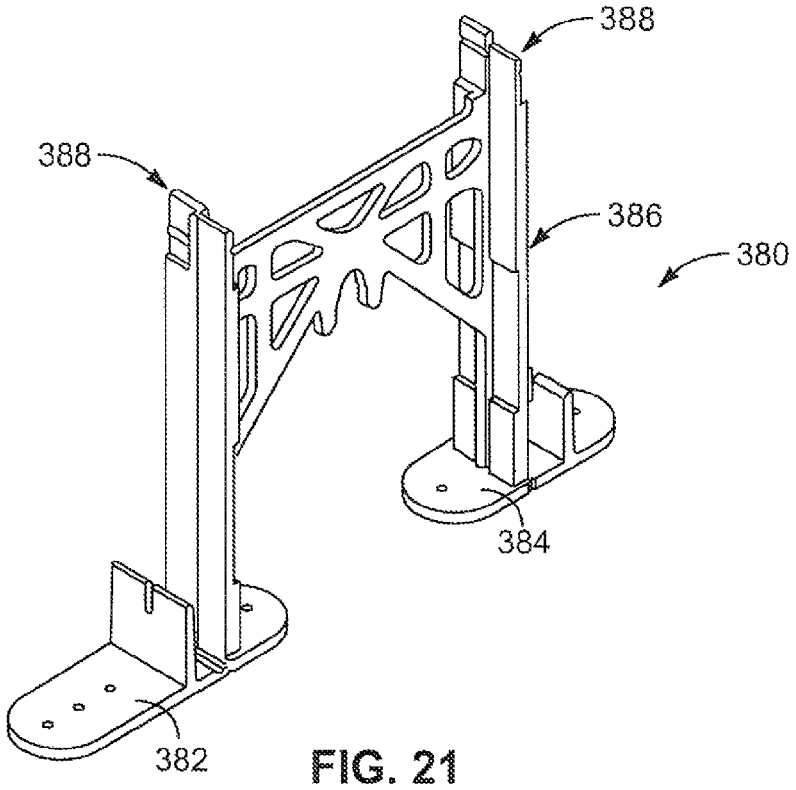
FIG. 21 is a perspective view of a base member for a tie system, depicting base portions and a wall tie having a unitary seamless structure, according to another embodiment of the present invention.

With respect to FIG. 21, another embodiment of a base member 380 for a tie system is shown. In particular, the base member 380 of this embodiment includes a first base portion 382, a second base portion 384 and a all tie portion 386, each integrally formed together in a unitary and seamless arrangement. Other wall ties and/or intermediate adapters (not shown), such as the upright wall tie and intermediate adapters depicted in FIG. 18, may then be attached to upper end portions 388 of the wall tie portion 386. With this arrangement, the base member 380 may be positioned and secured over a concrete footing (not shown) to establish a base for a tie stack, then additional wall ties may be attached to the base member and vertically stacked to the height desired to form a tie stack, as set forth in previous embodiments.

Figure 22:
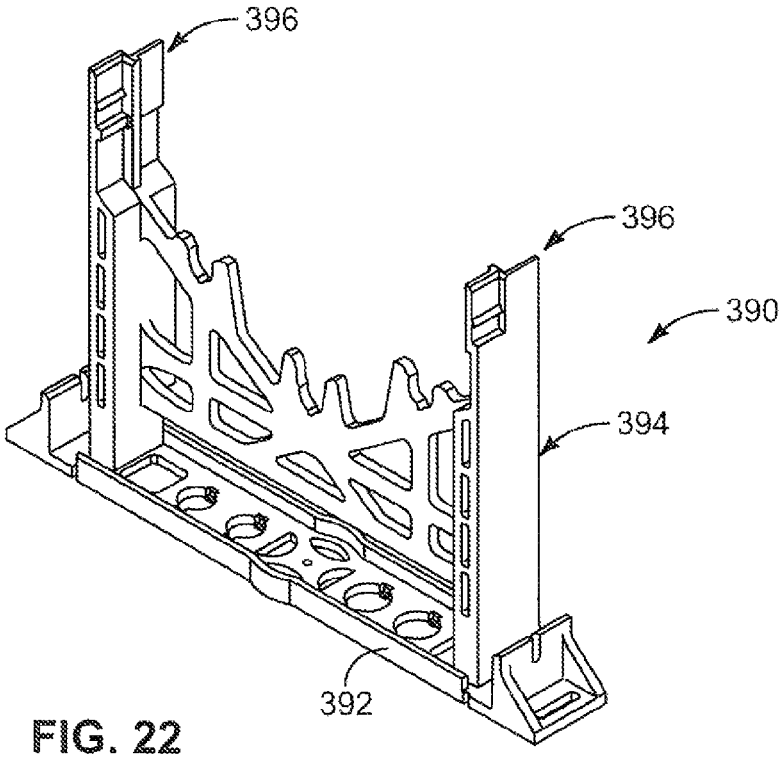
FIG. 22 is a perspective view of a base member for a tie system, depicting the base tie and wall tie of FIG. 3 having a unitary seamless structure, according to another embodiment of the present.

With respect to FIG. 22, another embodiment of a base member 390 for a tie system is depicted. This embodiment is similar to the base tie and wall tie depicted in FIG. 3, except in this embodiment, a base tie 392 and a wall tie portion 394 may be integrally formed together in a unitary seamless structure. Similar to the previous embodiment, the base member 390 may be positioned and secured to a footing (not shown), after which, additional wall ties may be attached to the end portions 396 of the wall tie portion 394 and vertically stacked to the height desired for a tie stack. Multiple tie stacks may be positioned and secured to the footing for securing panel structures thereto to act as forms for pouring a concrete wall (not shown).

Figure 23:
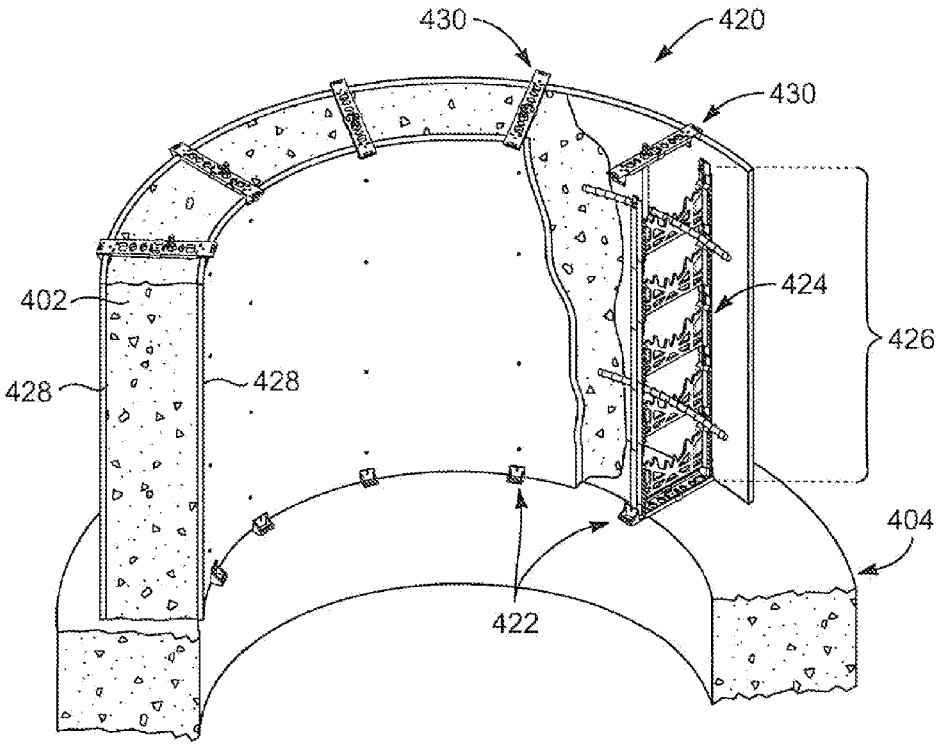
FIG. 23 is a perspective view of a tie system between panel structures, with portions removed, for forming a wall with a radius, according to one embodiment of the present invention.

With reference to FIG. 23, another embodiment of a tie system 420 is shown. In this embodiment, the tie system 420 may be the same or similar to the tie system depicted in FIG. 1, except the tie system 420 is employed for supporting panel structures 428 over a footing 404 with a radius or curved footing. Similar to that set forth with respect to FIG. 1, the tie system 420 of this embodiment may be best suited for forming walls for a home, or the like, which may be used for straight walls or walls where a radius is desired. The tie system 420 over the curved footing 404 may include multiple tie stacks 426. Each tie stack 426 may include a base member 422 or base tie and one or more Wall ties 424. The panel structures 428 employed with the cured footing may be bendable plywood, masonite or plastic panels that will provide sufficient strength to act as a temporary form, but also may readily bow or bend. In this manner, the tie system 420 as previously depicted in FIG. 1 may also be utilized over the curved footing 404 to provide a corresponding radius for a wall 402.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention includes all modifications, equivalents, and alternatives falling within the spirit and scope of the invention as defined by the following appended claims.

What is claimed is:

1. A tie system configured to support panel structures over a footing for a hardenable building material, the tie system comprising:

a first base portion having a first base extension and a first upstanding portion and a second base portion having a second base extension and a second upstanding portion, the first and second base extensions each including a planar underside surface configured to extend horizontally over the footing and configured to be securable to and seat against an upper surface of the footing, the first and second upstanding portions of the first base portion and the second base portion each configured to extend vertically from the first base extension and the second base extension, respectively, the first base portion defining a first channel, at least partially defined by the first upstanding portion, configured to receive and secure to a first panel structure and the second base portion defining a second channel, at least partially defined by the second upstanding portion, configured to receive and secure to a second panel structure; and a wall tie including a first elongated wall portion and a second elongated wall portion with a cross-member portion extending therebetween, the first and second elongated wall portions and the cross-member of the wall tie being a monolithic structure, the wall tie being a separate and discrete structure from the first and second base portions, the first elongated wall portion configured to vertically extend from and be removably connected to the first upstanding portion of the first base portion and the second elongated wall portion configured to vertically extend from and be removably connected to the second upstanding portion of the second base portion, the first elongated wall portion including a first flat surface and the second elongated wall portion including a second flat surface, the first flat surface facing away from and directly opposite the second flat surface such that the first flat surface is configured to be fastened to an inner surface of the first panel structure and the second flat surface is configured to be fastened to an inner surface of the second panel structure.

2. The tie system of claim 1, wherein the first base portion is separate and discrete from the second base portion and configured to be interconnected by the wall tie.

3. The tie system of claim 1, further comprising one or more other wall ties each including the first and second elongated wall portions with the cross-member portion extending therebetween, the one or more other wall ties configured to vertically stack and mate to each other to form a vertically extending tie stack such that the first and second elongated wall portions vertically extend from and attach to each other.

4. The tie system of claim 3, further comprising an intermediate adapter configured to be coupled between the wall tie and the one or more other wall ties.

5. The tie system of claim 3, wherein the first flat surface of each of the wall ties is configured to be secured to an inner most surface of one or more first panel structures and the second flat surface of each of the wall ties is configured to be secured to an inner most surface of one or more second panel structures.

6. The tie system of claim 5, wherein the cross-member portion of each wall tie within the tie stack is configured to be positioned generally in a common plane, the common plane configured to be perpendicular to the footing and configured to be perpendicular to the first flat surface and the second flat surface of each of the wall ties.

7. The tie system of claim 5, further comprising a finish tie having an elongated portion extending between a first end portion and a second end portion, each of the first end portion and the second end portion defining a channel therein, each channel of the finish tie being configured to be positioned over and maintained on the respective one or more first and second panel structures.

8. The tie system of claim 1, wherein the first base portion and the second base portion are unitary and seamless relative to the wall tie.

9. The tie system of claim 1, wherein the base extension of at least one of the first base portion and the second base portion includes a bendable portion for securing a portion of the base extension over a side surface of the footing.

10. A tie system configured to support first and second panel structures over a footing to receive a hardenable building material, the tie system comprising:

multiple base members each having an elongated portion defining a longitudinal length with an underside planar surface configured to be positioned over and securable against an upper surface of a footing in a spaced apart arrangement such that each elongated portion of the multiple base members is oriented transverse to an elongated length of the footing; and multiple wall ties configured to be directly coupled together to form multiple vertically extending wall tie stacks, each wall tie stack configured to be coupled to one or more of the multiple base members to form a tie stack, each wall tie including:

a first elongated wall portion and a second elongated wall portion with a cross-member portion extending therebetween, the first and second elongated wall portions and the cross-member of the wall tie being a monolithic structure, the first elongated wall portion including a first flat surface and the second elongated wall portion including a second flat surface, the first flat surface facing away from and directly opposite the second flat surface, wherein the first flat surface of each of the wall ties is configured to be secured to an inner most surface of one or more first panel structures and the second flat surface of each of the wall ties is configured to be secured to an inner most surface of one or more second panel structures; and wherein the first flat surface and the second flat surface of one wall tie forms a substantially continuous flat surface relative to the respective first flat surface and second flat surface of an adjacently coupled wall tie.

11. The tie system of claim 10, wherein the cross-member portion of each wall tie within the tie stack is configured to extend generally in a common plane, the common plane configured to be substantially perpendicular to the footing and configured to be substantially perpendicular to the first flat surface and the second flat surface of the wall ties.

12. The tie system of claim 10, further comprising multiple finish ties, each finish tie having an elongated portion extending between a first end portion and a second end portion, each of the first end portion and the second end portion defining a channel therein, each channel of the finish tie being configured to be positioned over and secured to the respective one or more first and second panel structures.

13. The tie system of claim 10, wherein the multiple base members comprise a first base portion and a second base portion configured to be coupled to the wall tie stack, the first base portion and the second base portion each including a base extension and an upward extending portion, the upward extending portion configured to be connected to a bottom one of the wall ties of the wall tie stack.

14. The tie system of claim 10, wherein the base members are configured to be positioned along a curved footing portion with a radius so that the vertically extending tie stacks correspond with the base members to facilitate the one or more first and second panel structures being secured to the tie stacks with a panel structure radius that corresponds with the radius of the curved footing portion of the footing.

* * * * *